US011098721B2

(12) United States Patent
Le et al.

(10) Patent No.: US 11,098,721 B2
(45) **Date of Patent: *Aug. 24, 2021**

(54) SPA TUB AND SPA CHAIR HAVING A SPRAYER WITH A THERMAL METER

(71) Applicants: Kevin Le, Richland Hills, TX (US); Thanh Le, Arlington, TX (US)

(72) Inventors: Kevin Le, Richland Hills, TX (US); Thanh Le, Arlington, TX (US)

(73) Assignee: Luraco, Inc., Arlington, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/510,862

(22) Filed: Jul. 12, 2019

(65) Prior Publication Data

US 2019/0360493 A1 Nov. 28, 2019

Related U.S. Application Data

(63) Continuation-in-part of application No. 16/276,351, filed on Feb. 14, 2019, now Pat. No. 10,357,427, and (Continued)

(51) Int. Cl.
*F04D 13/02* (2006.01)
*F04D 25/02* (2006.01)
(Continued)

(52) U.S. Cl.
CPC ..... *F04D 13/024* (2013.01); *F04D 13/026* (2013.01); *F04D 13/0633* (2013.01); (Continued)

(58) Field of Classification Search
CPC ..... A61H 33/6026; A61H 35/006; A61H 33/6063; A61H 33/6047; A61H 33/6042; A61H 2033/0083; A61H 2201/5058; A61H 2033/023; A61H 2201/1207; A61H 33/0091; F04D 13/024; F04D 13/026; F04D 25/026; F04D 29/047; F04D 29/0465; F04D 13/0633; F04D 13/064; F05B 2240/50;
(Continued)

(56) References Cited

U.S. PATENT DOCUMENTS 3,636,944 A * 1/1972 Bryant ..... A61H 33/025 601/16
3,641,996 A * 2/1972 Friend ..... A61H 33/0087 601/157
(Continued)

*Primary Examiner* — Quang D Thanh
(74) *Attorney, Agent, or Firm* — Hoang Steve Ngo

(57) ABSTRACT

The present invention is directed to a spa tub (and to a spa chair that includes a spa tub) that has a sprayer with a thermal meter so that an employee does not need to touch or feel the water and/or fluids to gauge the temperature of the water and/or fluids. The spa tub may also have a water pump and/or an air pump assembly that is designed and configured to be mounted to the wall of a basin for providing massage therapy to a user. In addition, the spa tub may additionally have a liner and/or an air dispenser. As a non-limiting embodiment, a spa chair includes a spa tub, a basin, a mounting housing member, and a sprayer with a thermal meter. The spa chair may also include a jet assembly, an air pump assembly a spa base, a gasket or seal, an air dispenser, and/or a liner.

32 Claims, 24 Drawing Sheets

Related U.S. Application Data a continuation-in-part of application No. 15/833,510, filed on Dec. 6, 2017, now Pat. No. 10,451,071, which is a continuation of application No. 15/237,595, filed on Aug. 15, 2016, now Pat. No. 10,302,088, which is a continuation-in-part of application No. 13/923,364, filed on Jun. 20, 2013, now Pat. No. 9,926,933.

(51) Int. Cl.

| | |
|---|---|
| ***F04D 29/047*** | (2006.01) |
| ***F04D 29/046*** | (2006.01) |
| ***F04D 13/06*** | (2006.01) |
| *F21Y 115/10* | (2016.01) |
| *A61H 33/00* | (2006.01) |
| *F21V 19/00* | (2006.01) |

(52) U.S. Cl.

CPC ..... *F04D 25/026* (2013.01); *F04D 29/047* (2013.01); *F04D 29/0465* (2013.01); *A61H 33/0091* (2013.01); *A61H 2033/0083* (2013.01); *A61H 2201/1207* (2013.01); *F04D 13/064* (2013.01); *F05B 2240/14* (2013.01); *F05B 2240/50* (2013.01); *F21V 19/003* (2013.01); *F21Y 2115/10* (2016.08)

(58) Field of Classification Search

CPC . F05B 2240/14; F21Y 2115/10; F21V 19/003
See application file for complete search history.

(56) References Cited

U.S. PATENT DOCUMENTS 4,099,522 A * 7/1978 Alenares ..... A61H 35/006 601/156
4,161,881 A * 7/1979 Raz ..... B05B 1/18 374/147
4,210,284 A * 7/1980 Tarnay ..... B05B 12/10 137/468
5,160,197 A * 11/1992 Klose ..... E03C 1/0409 374/147
5,172,860 A * 12/1992 Yuch ..... G01K 13/02 239/211
5,807,289 A * 9/1998 Camp ..... A61H 33/0091 4/541.3
6,401,273 B1 * 6/2002 Fung ..... A61H 33/0091 4/541.4
10,357,427 B1 * 7/2019 Le ..... A61H 33/6042
10,451,071 B2 * 10/2019 Le ..... F04D 13/024
2004/0060108 A1 * 4/2004 Hoon Park ..... A61H 35/006 4/622
2004/0177438 A1 * 9/2004 Gruenwald ..... A61H 33/0091 4/560.1
2005/0204466 A1 * 9/2005 Luong ..... A61H 35/006 4/622
2007/0226897 A1 * 10/2007 Fugate ..... A61H 35/006 4/622
2009/0230729 A1 * 9/2009 Lusk ..... B29C 70/443 296/193.07
2010/0281611 A1 * 11/2010 Veltri ..... A61H 35/006 4/541.1
2011/0004994 A1 * 1/2011 Le ..... A61H 33/005 4/541.1
2011/0163182 A1 * 7/2011 Bischoff ..... A61H 33/6063 239/209
2011/0253236 A1 * 10/2011 Le ..... F04F 5/10 137/565.22
2014/0150176 A1 * 6/2014 Tran ..... A61H 35/006 4/622
2015/0311775 A1 * 10/2015 Singh ..... H02K 35/02 290/55
2016/0081877 A1 * 3/2016 Marconi ..... A47K 3/024 4/496
2016/0095794 A1 * 4/2016 Eveleigh ..... A61H 35/02 4/620
2016/0348681 A1 * 12/2016 Le ..... F04D 25/026
2018/0254687 A1 * 9/2018 Hober ..... H02K 15/02
2018/0269696 A1 * 9/2018 Shropshire ..... H02P 27/06
2019/0186741 A1 * 6/2019 Lowery ..... H05H 1/46

* cited by examiner

SPA TUB AND SPA CHAIR HAVING A SPRAYER WITH A THERMAL METER

CROSS-REFERENCE TO RELATED APPLICATIONS

The present application is a continuation-in-part application of and claims the priority benefit of U.S. Nonprovisional patent application Ser. No. 15/833,510, filed on Dec. 6, 2017 and which is a continuation application of and claims the priority benefit of U.S. Nonprovisional patent application Ser. No. 15/237,595, filed on Aug. 15, 2016 and which is a continuation-in-part application of and claims the priority benefit of U.S. Nonprovisional patent application Ser. No. 13/923,364, filed on Jun. 20, 2013, all of which are incorporated herein by reference in their entireties. The present application is also a continuation-in-part application of and claims the priority benefit of U.S. Nonprovisional patent application Ser. No. 16/276,351, filed on Feb. 14, 2019 and issuing as U.S. Pat. No. 10,357,427 on Jul. 23, 2019, which is also incorporated herein by reference in its entirety.

BACKGROUND OF THE INVENTION

Field of the Invention

The present invention generally relates to spa devices, components, and systems in manicure and pedicure industries and in similar industries related to jacuzzis, bathtubs, and swimming pools. More specifically, the present invention is directed to a spa tub (and to a spa chair that includes a spa tub) having a sprayer with a thermal meter or gauge so that a worker or employee does not need to touch or feel the water and/or fluids to gauge the temperature of the water and/or fluids. Some customers have diabetes such that their skin is less sensitive to temperature. Knowing the temperature of the water and/or fluids in the spa service industries is very important. The spa tub may also include a fluid pump assembly or an air pump assembly that is designed and configured to be mounted to the wall of a basin for providing massage therapy to a user. In addition, the spa tub may further include a liner and/or an air dispenser.

Description of the Related Art

Spa devices, components, and systems are known in the art. Spa devices are used in commercial and recreational settings for hydrotherapy, massage, stimulation, pedicure, and bathing purposes. In the spa application setting, there are sanitization and/or cleanliness issues with workers or employees touching the water and/or fluids in basins of customers prior to or during use.

Further, the issues with sanitization in the spa industry today may require the use of a liner, such as a disposable liner. But with a liner, traditional water sensors in spa devices and settings, such as foot spas, will not be able to effectively detect fluids or water anymore. Thus, there exists a need for a pump having a contactless, fluid sensor adapted for use with a liner for dispensing a fluid to a setting such that fluid or water level can be effectively detected in a setting, such as, but not limited, a foot spa, a spa, a jacuzzi, a bathtub, or a swimming pool.

In addition, typical spa devices include a motor that drives a pump to circulate water from the spa device. In particular, a shaft of the motor is used to directly mount an impeller, which is then used to circulate water into and out of the spa device. Since the motor may not operate wet, a seal or a series of seals may be required to prevent water from entering the motor. The seals will wear to the point where water will enter the motor and consequently, the entering water may cause the motor to burn out. At this point, the motor assembly will need to be replaced in order to continue operation. This is expensive and may take several hours in which to perform.

Further, because typical spa devices have extensive piping systems that are built into the spa device to transport air and water, the spa devices are traditionally difficult to clean. This results in downtime and complicated maintenance schedules to clean such spa devices. Furthermore, if a spa device has a light source associated with it, to replace or repair such a light source can be time consuming and complicated when the light source is not easily accessible.

Additionally, for magnetic coupling-type pumps, it is almost impossible to have a perfect alignment between the motor shaft axis and the impeller rotation axis. The imperfect alignment or misalignment will result in high vibration noise.

Therefore, it is desired in manicure and pedicure industries and in similar industries that a spa tub (and to a spa chair that includes a spa tub) having a sprayer with a thermal meter or gauge so that a worker or employee does not need to touch or feel the water and/or fluids to gauge the temperature of the water and/or fluids.

In addition, it is desired in manicure and pedicure industries and in similar industries that a spa tub (and that a spa chair that includes a spa tub) has a sprayer with a thermal meter or gauge and/or a water pump and/or an air pump mechanism.

Furthermore, it is desired in manicure and pedicure industries and in similar industries that a spa tub (and that a spa chair that includes a spa tub) has a sprayer with a thermal meter or gauge and a liner.

Additionally, it is desired in manicure and pedicure industries and in similar industries that a spa tub (and that a spa chair that includes a spa tub) has a sprayer with a thermal meter or gauge with any combination of components that are described, discussed and/or shown below and in the drawings.

The present invention overcomes one or more of the shortcomings of spa devices, components, and systems in manicure and pedicure industries and in similar industries. The Applicant is unaware of inventions or patents, taken either singly or in combination, which are seen to describe the present invention as claimed.

SUMMARY OF THE INVENTION

The present invention is directed to a spa tub (and to a spa chair that includes a spa tub) that has a sprayer with a thermal meter or gauge so that a worker or employee does not need to touch or feel the water and/or fluids to gauge the temperature of the water and/or fluids. The spa tub may also have a water pump and/or an air pump assembly that is designed and configured to be mounted to the wall of a basin for providing massage therapy to a user. In addition, the spa tub may additionally have a liner and/or an air dispenser.

As a non-limiting embodiment of the present invention, a spa chair includes a spa tub, a basin, a mounting housing member, and a sprayer with a thermal meter or gauge. The spa chair may also include at least one of the following: a jet assembly, an air pump assembly a spa base, a gasket or seal, an air dispenser, and a liner. When the spa tub is combined with a massage chair, the present invention is referred to as a spa chair

It should be understood that the above-attached figures are not intended to limit the scope of the present invention in any way.

DETAILED DESCRIPTION OF THE PREFERRED EMBODIMENTS

Figure 1:
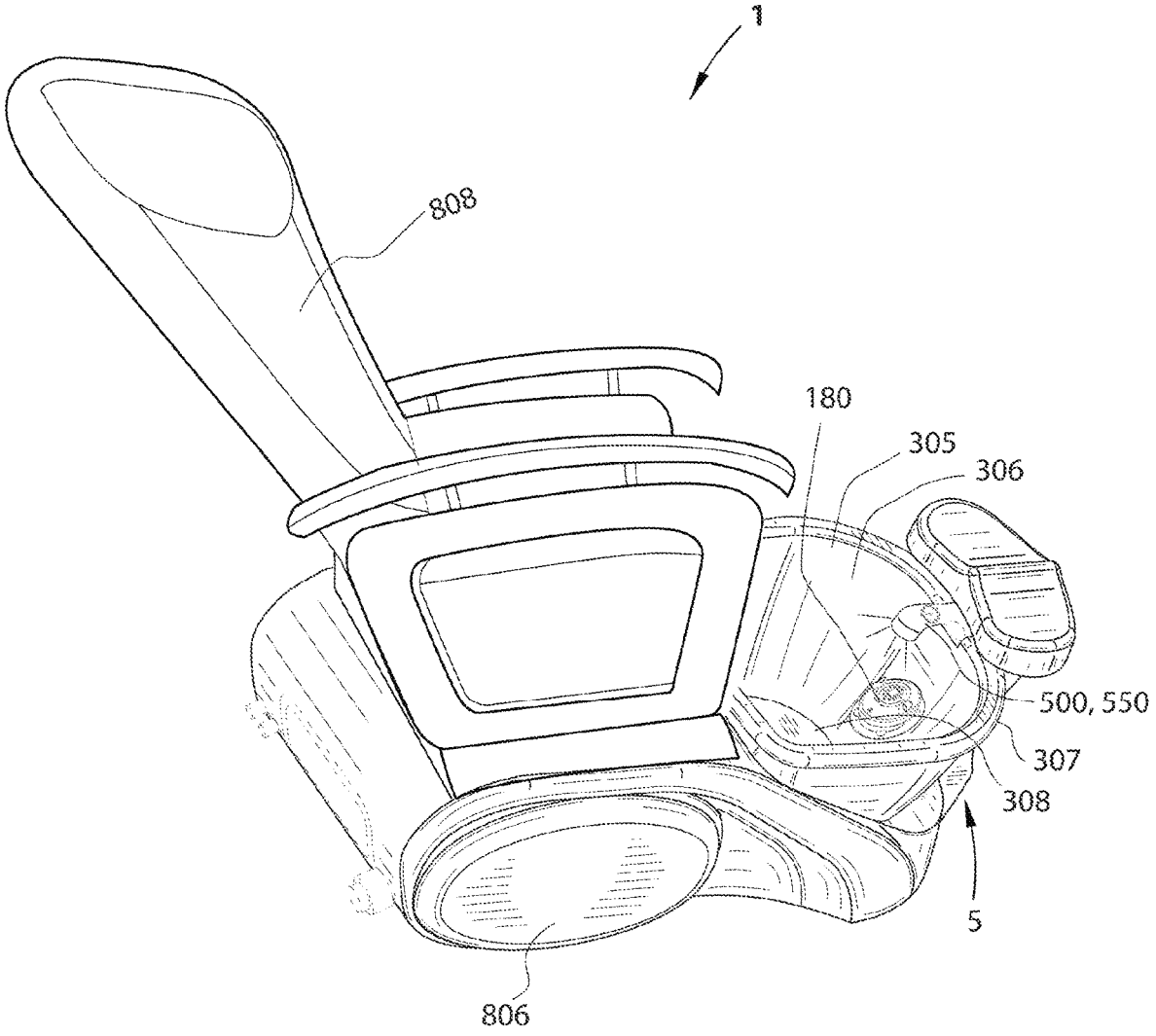
FIG. 1 is a perspective view of a spa chair according to the present invention.

Referring to FIGS. 1-34, the present invention is directed to a spa tub 5 (and, as shown in FIG. 1, to a spa chair 1 that includes a spa tub 5) having a sprayer 500,550 with a thermal meter or gauge 510,560 so that a worker or employee does not need to touch or feel the water and/or fluids to gauge the temperature of the water and/or fluids. The spa tub 5 may also include fluid pump assembly 180 or an air pump assembly 601,701 that is designed and configured to be mounted to the sidewall 406 of a basin 405 for providing massage therapy to a user. In addition, the spa tub 5 may further include a liner 290 and/or an air dispenser.

As best shown in FIG. 1, a non-limiting embodiment of the present invention is a spa chair 1 that includes a massage chair 808 and a spa tub 5 that includes a basin 305,405, a mounting housing member 250, and a sprayer 500,550 with a thermal meter or gauge 510,560. The spa tub 5 may also include at least one of the following: a jet assembly 180, an air pump assembly 601,701, a spa base 806, a gasket or seal 265,619, an air dispenser, and a liner 290.

The term "basin" as used in this application represents any basin, bath, tub, container, and any structure known to one of ordinary skill in the art that is used in the manicure and pedicure industries and in similar industries for holding, containing or retaining a certain volume of water, fluids, chemicals, and/or substances and for allowing a user to dip or immerse a relevant body portion of the user into the water, fluids, chemicals, and/or substances that is present in the basin.

As shown in FIG. 1, basin 305 includes a plurality of sidewalls 306, a top rim 307, and a base 308. The sidewalls 306 are coupled or formed together with the base 308 to define a volume. Basin 305 may be made or manufactured from any known material sufficient to support a volume of water, fluids, chemicals, and/or substances.

Figure 26:
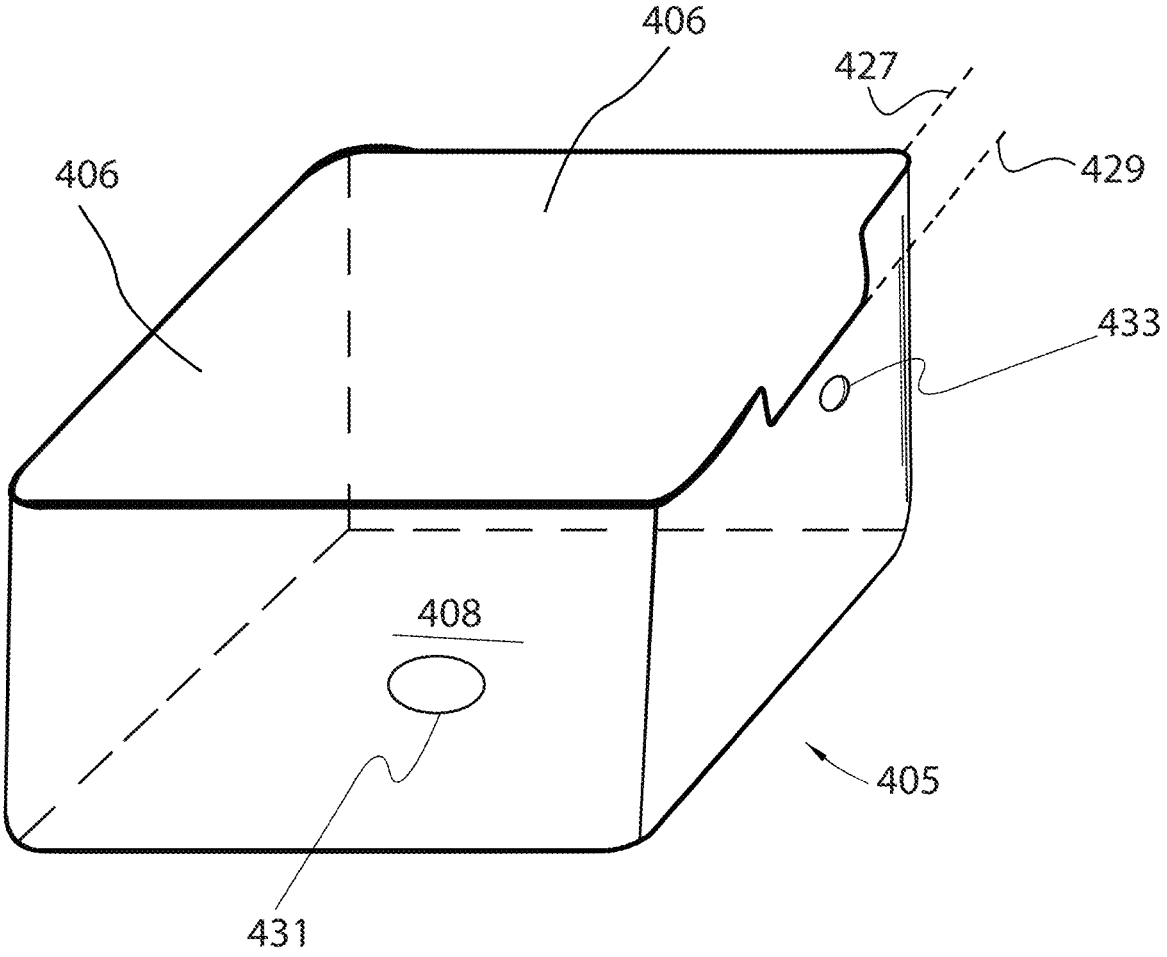
FIG. 26 is a perspective view of the basin of FIG. 19.
Figure 27A:
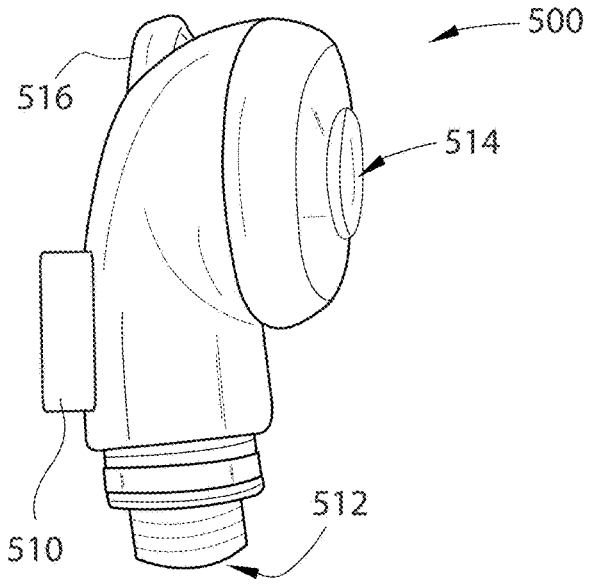
FIG. 27A is a side, perspective view of a sprayer with a thermal meter or gauge according to the present invention, showing a digital thermal meter.
Figure 28:
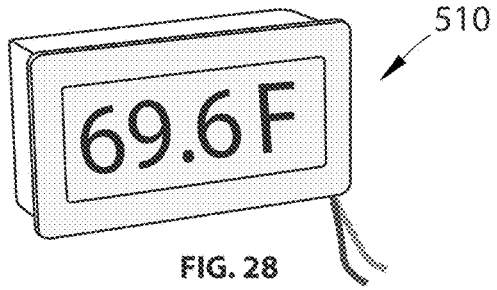
FIG. 28 is a front, perspective view of the digital thermal meter of FIG. 27B.
Figure 27B:
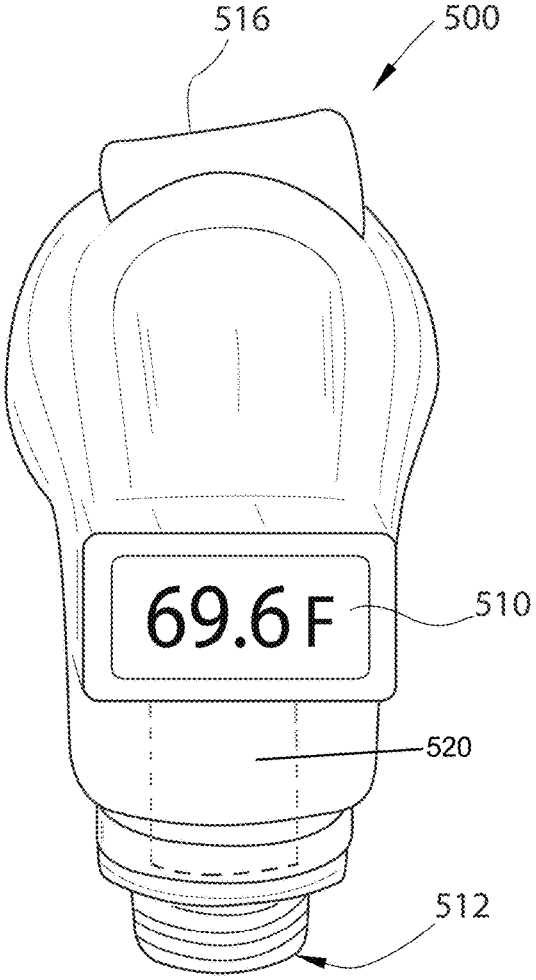
FIG. 27B is a front, perspective view of the sprayer of FIG. 27A.
Figure 29:
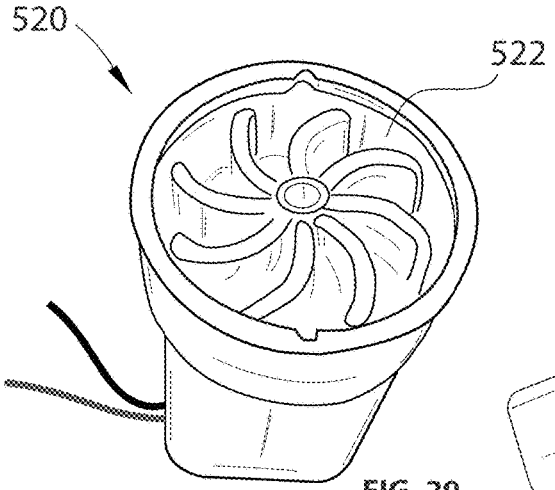
FIG. 29 is a front, top, perspective view of the electric generator of FIG. 27B.
Figure 30:
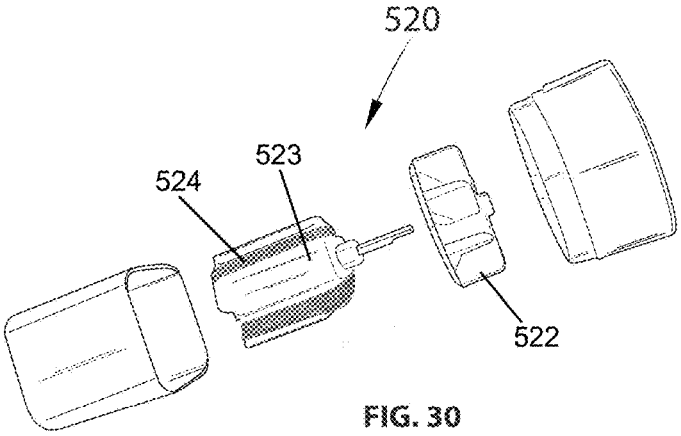
FIG. 30 is a side, perspective view of the electric generator of FIG. 27B.
Figure 31:
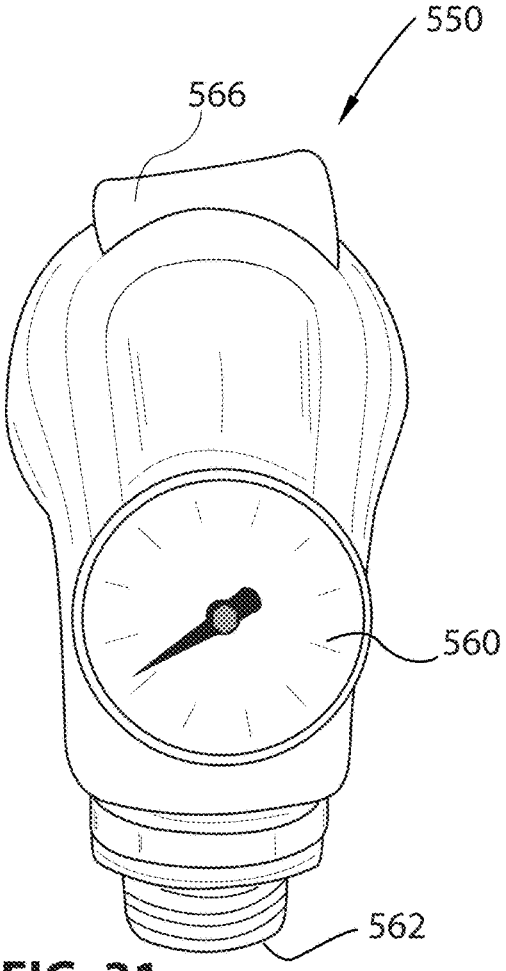
FIG. 31 is a front, perspective view of another sprayer with a thermal meter or gauge according to the present invention, showing an analog thermal meter.
Figure 32:
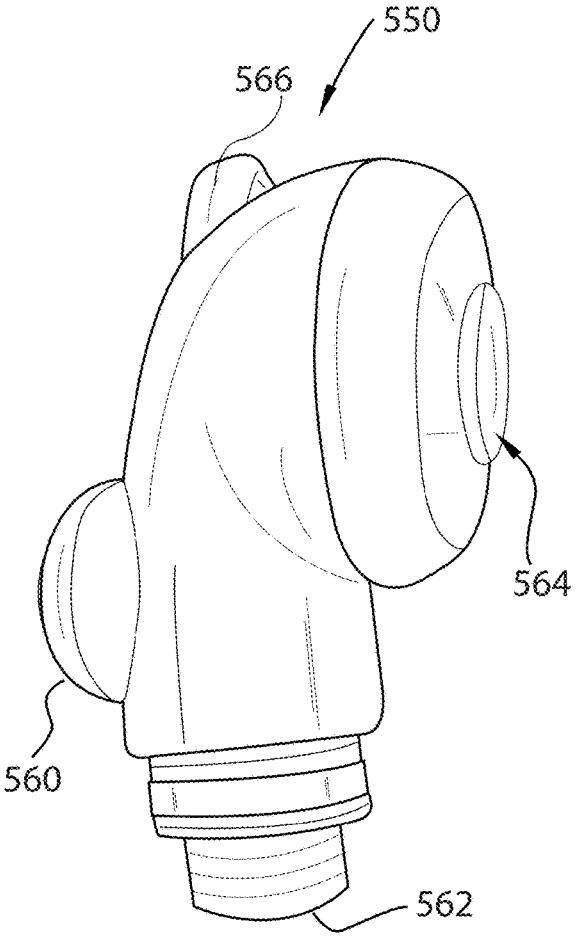
FIG. 32 is a side, perspective view of the sprayer with a thermal meter or gauge of FIG. 31.
Figure 33:
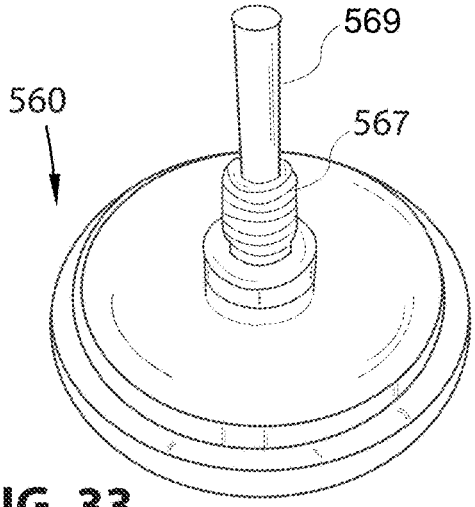
FIG. 33 is a rear, perspective view of the analog thermal meter of FIG. 31.
Figure 34:
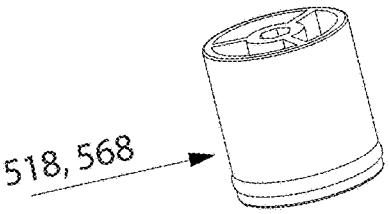
FIG. 34 is a perspective view of a backflow preventer.

As shown in FIG. 26 and as an alternative to basin 305, basin 405 includes a plurality of sidewalls 406 and a base 408 that are each coupled or formed together to define a volume. Basin 405 includes a top rim 427 defining an upper level of water, fluids, chemicals, and/or substances and a lower rim 429 defining a lower level of water, fluids, chemicals, and/or substances. Lower rim 429 is formed on one side, but is able to be formed on multiple sides if necessary. Liner 290 resides within the volume of space within basin 405. Water, fluids, chemicals, and/or substances is filled inside of liner 290. As a user inserts a portion of their body into the volume of water, fluids, chemicals, and/or substances, water, fluids, chemicals, and/or substances may overflow liner 290. Overflow may pass between liner 290 and basin 405 and flow down to drain hole 431 where it drains away from basin 405. A connector may be coupled to hole 431 for communication with a drainage system. As an option, an over flow preventer mounting hole 433 may be included on basin 405. Water, fluids, chemicals, and/or substances would be routed through hole 433 if the water, fluids, chemicals, and/or substances level got too high and hole 431 was not either operable or included with basin 405. Basin 405 may be made or manufactured from any known material sufficient to support a volume of water, fluids, chemicals, and/or substances.

Figure 2:
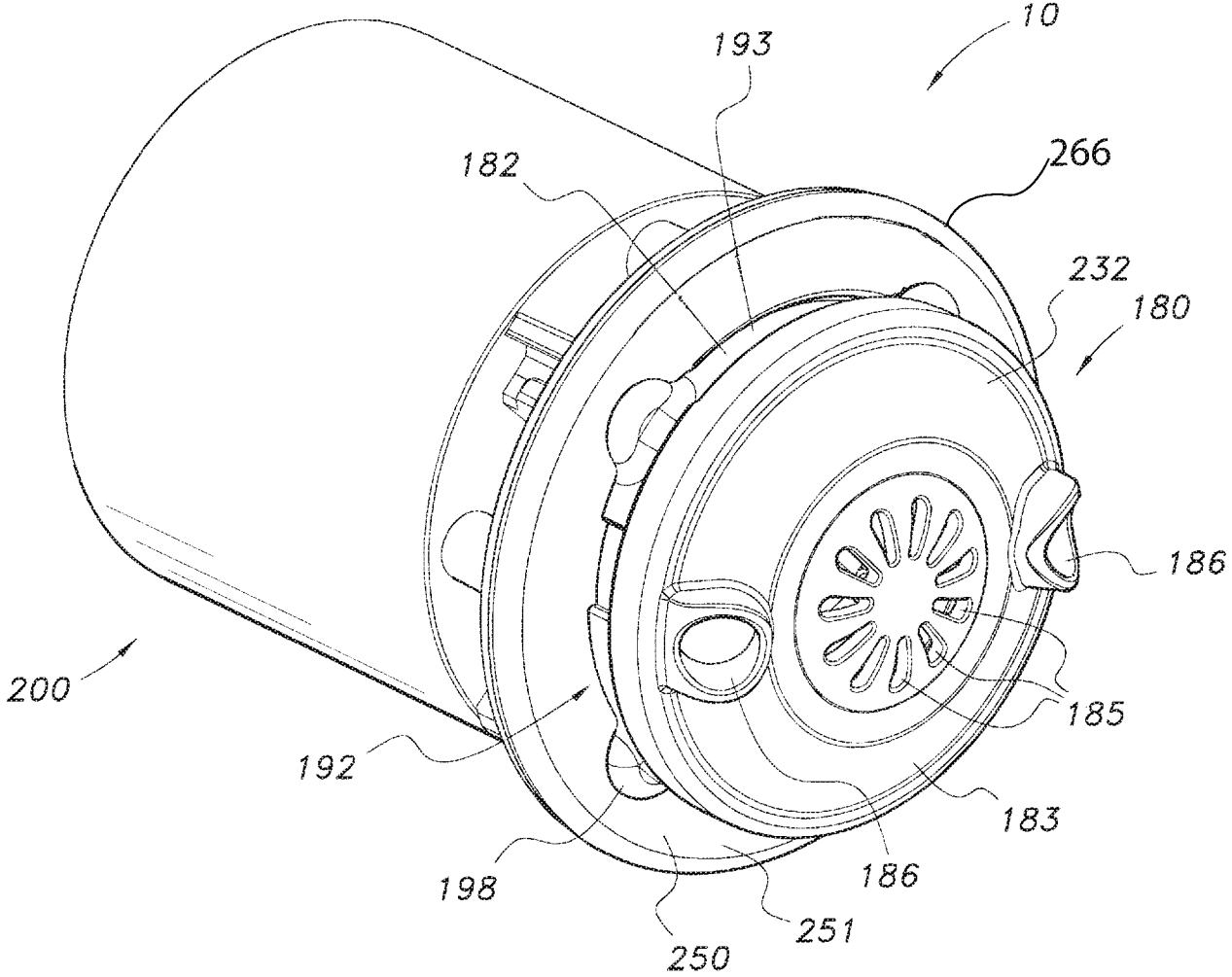
FIG. 2 is a front, right side, perspective view of a fluid pump according to the present invention, showing a jet assembly and a motor assembly secured or coupled to or about one another.
Figure 3:
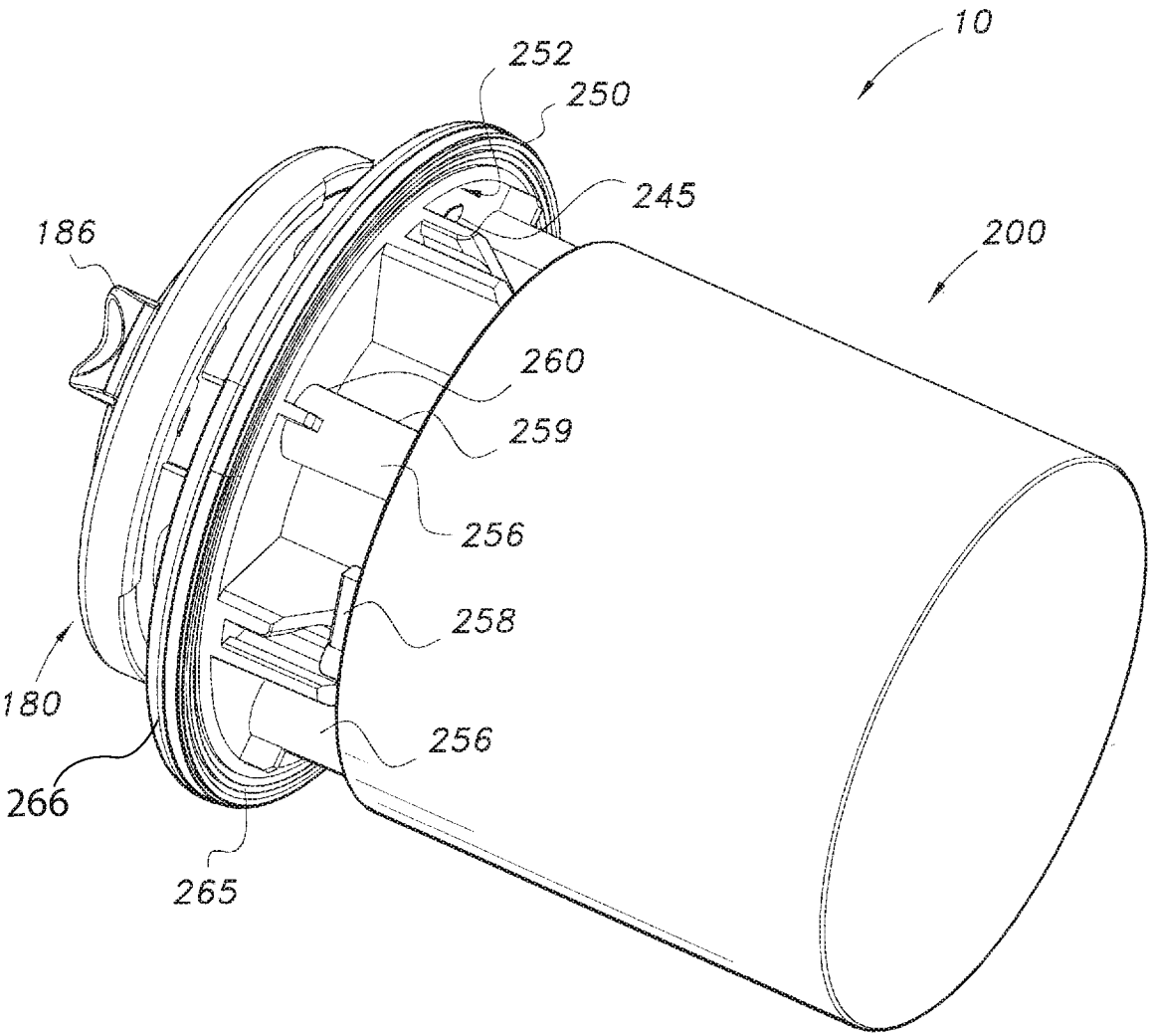
FIG. 3 is a rear, left side, perspective view of the fluid pump of FIG. 2.
Figure 4:
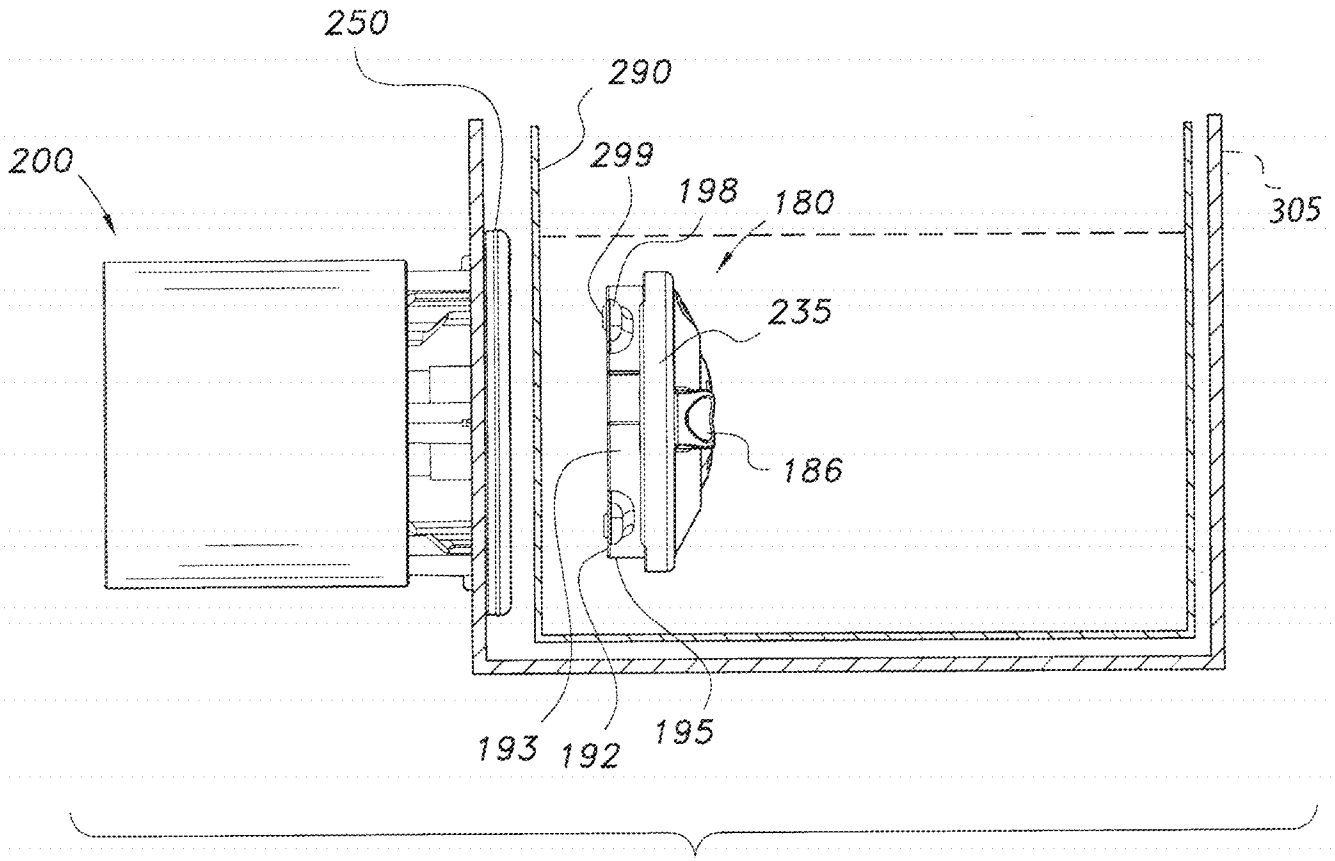
FIG. 4 is a right side, partial cross-sectional, environmental view of the fluid pump of FIG. 2, wherein the motor assembly is secured to or proximate to a setting, such as an internal wall of a foot spa, while the jet assembly will be secured or coupled to or about the motor assembly prior to operation or use, and wherein a liner will be positioned between the motor assembly and jet assembly prior to operation or use.
Figure 5:
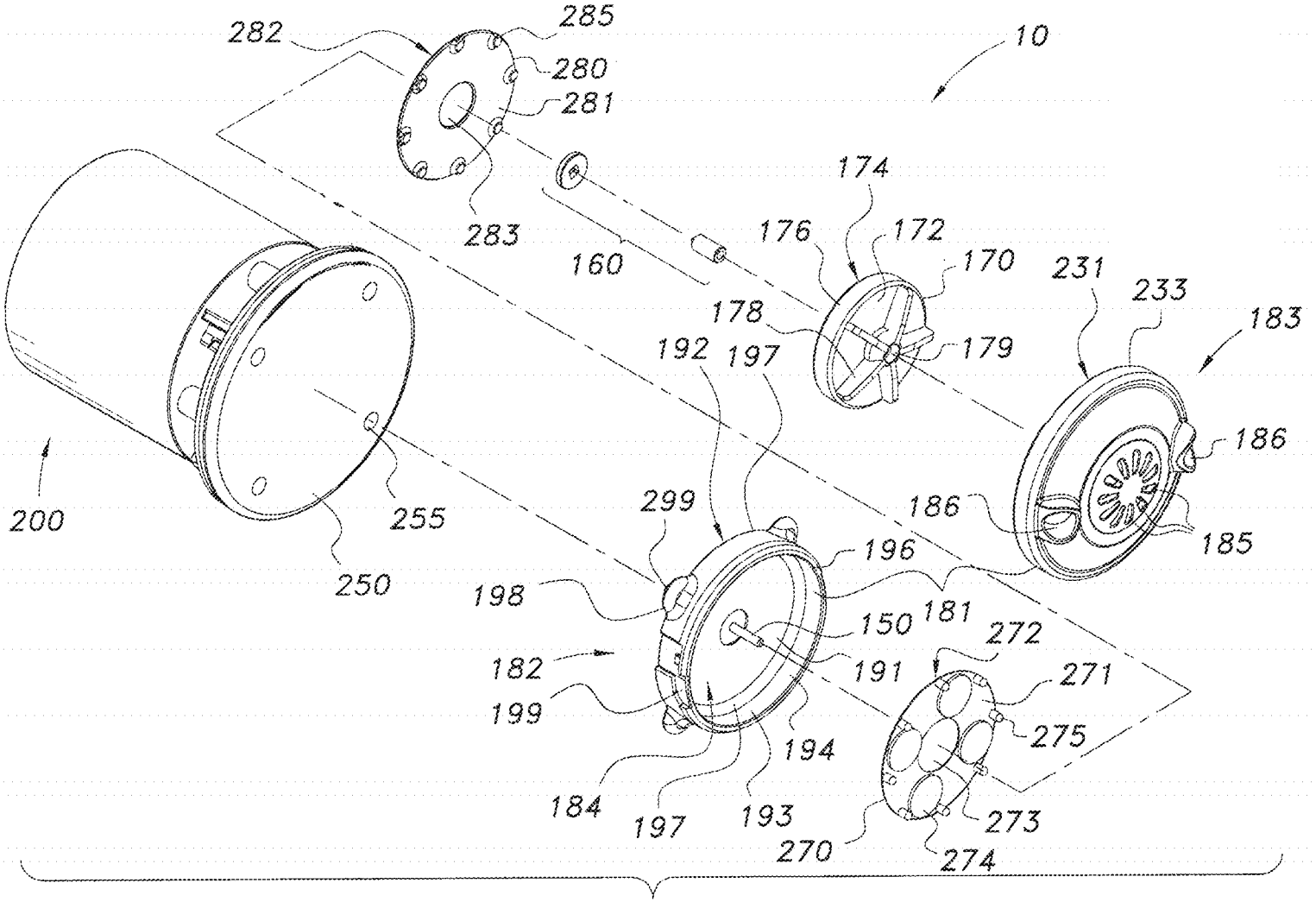
FIG. 5 is an exploded, perspective view of the fluid pump of FIG. 2.
Figure 6:
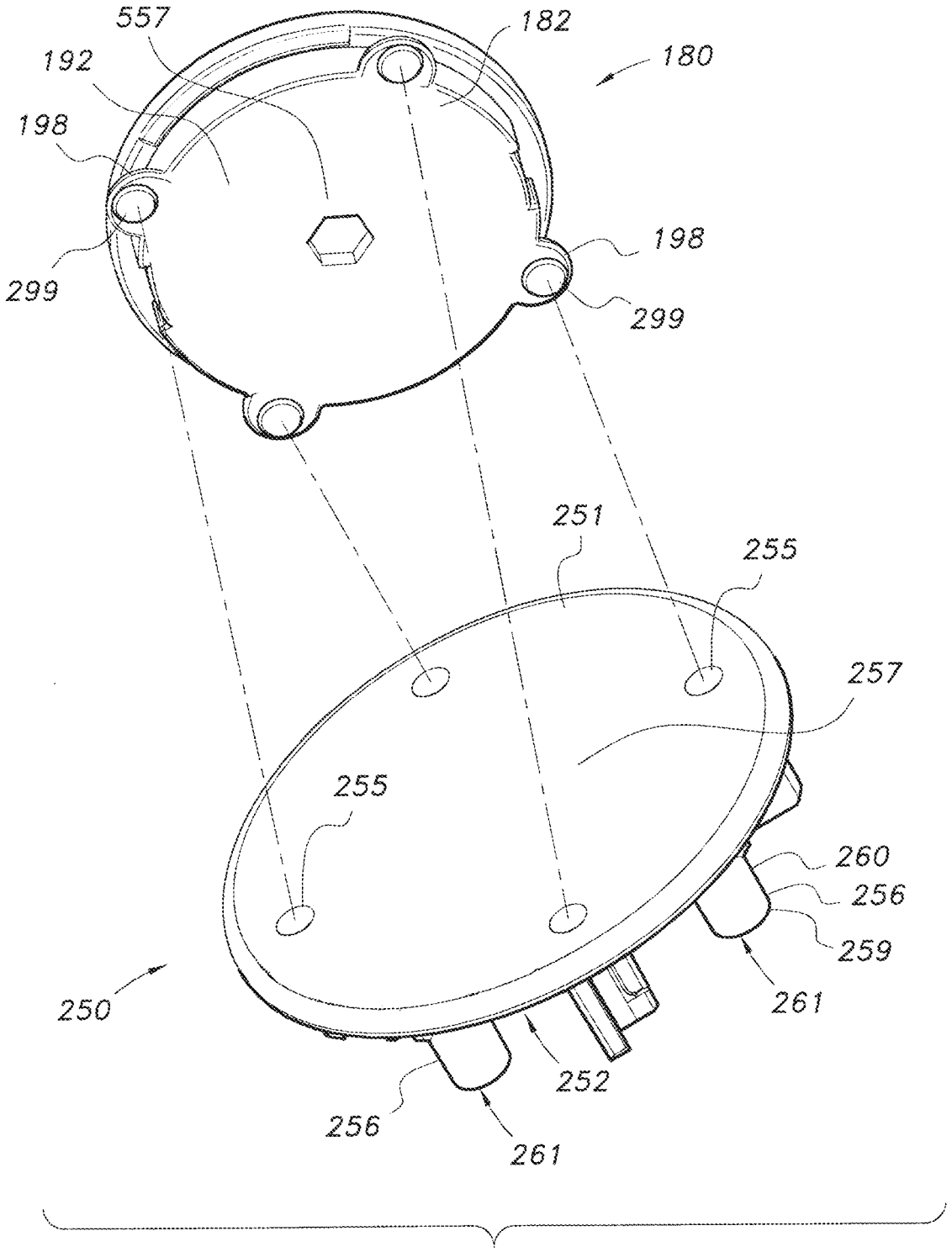
FIG. 6 is an exploded, perspective view of a jet assembly and a mounting housing member or coupling device according to the present invention.

As shown in FIGS. 2-6 and 17-18 and as best shown in FIG. 6 the mounting housing member 250 helps to secure, attach or couple the jet assembly 180 and motor assembly 200 together, or at least in proximity of one another, such that the jet assembly 180 and motor assembly 200 are in operative communication with one another. As a non-limiting example, the mounting housing member 250 includes a front (or top) side or surface 251, a rear (or bottom) side or surface 252, a shoulder 266, a plurality of engagement holes or ports 255, a plurality of mounting legs 256 extending rearwardly (or downwardly) from the rear (or bottom) side 252, and at least one wing nut 258. Preferably, the front (or top) side 251 is generally flat or has a generally flat, centrally-located section 257 that allows for a liner 290 to be positioned behind (or below) the base 182 of the jet assembly housing 181 and in front of (or above) the front or top side 251 of the mounting housing member 250 and motor assembly 200, as shown in FIGS. 4-6. Preferably, the generally flat section is at least 10% of the front (or top) side 251 for accommodating a liner 290 being positioned between the base 182 of the jet assembly housing 181 and the front (or top) side 251 of the mounting housing member 250. Each of the plurality of engagement holes or ports 255 is dimensioned and configured for receiving the corresponding knob 299 that extends rearwardly or downwardly from the corresponding feet extension 198 of the base 182 of the jet assembly housing 181. The securement, attachment or engagement of the knobs 299 of the plurality of feet extensions 198 to or inside the plurality of engagement holes or ports 255 of the mounting housing member 250 prevents the rotation of the base 182 and front or top cover 183 of the jet assembly housing 181 when the fluid pump 10,300 is in operation, and thus form the jet assembly rotation locking mechanism. Each of the plurality of mounting legs 256 has a first end 259, a second end 260, and a hollow channel 261 extending from the first end 259 toward the second end 260. Each hollow channel 261 is dimensioned and configured for receiving a corresponding screw (not shown) of a plurality of screws when the motor assembly 200 is to be secured to the mounting housing member 250. Preferably, the wing nut 258 rotates to extend out to provide a lock for the securement or installation of the mounting housing member 250 to the setting, such as, but not limited to, a sidewall 306,406 of a basin 305,405 or spa. The plurality of screws and wing nut 258 secure or attach the mounting housing member 250 to the sidewall 306,406 of the basin 305,405 when the user screws or tightens the screws into the hollow channel 261 of the mounting legs 256 and rotates the wing nut 258. The tightening of the screws into the hollow channel 261 of the mounting legs 256 and rotation of the wing nut 258 causes pressure to be applied to the gasket or seal 265 such that a strong seal will form between the gasket or seal 265 and contact surface of the sidewall 306,406 of the basin 305,405. The mounting housing member 250 may be made or manufactured of plastic, hard plastic, and/or any other suitable material known to one of ordinary skill in the art. Preferably, the mounting housing member 250 is made or manufactured of a plastic material to allow for magnetic field penetration from the motor assembly 200, without any, or with minimal, magnetic field loss. This allows for a magnet or magnets of smaller size, in comparison to a magnet or magnets needed when the mounting housing member 250 is made or manufactured of a non-plastic material, to be used, and, thus, reducing cost for magnets.

As shown in FIG. 2, the gasket or seal 265, preferably a ring-shaped or ring-type gasket, acts or serves as a fluid or water seal to prevent fluid or water from getting past the contact surface of the sidewall 306,406 of the basin 305,405 and making contact with the motor assembly 200 during use of the fluid pump 10. As shown in FIG. 3, the gasket 265 is secured to and positioned below (or behind) and adjacent to the rear or bottom side 252 of the mounting housing member 250 and above (or in front of) and adjacent to the contact surface of the sidewall 306,406 of the basin 305,405. Preferably, the gasket 265 is made or manufactured of a rubber material.

With regard to a fluid pump 10,300, the jet assembly 180 is secured, attached or coupled to the motor assembly 200, and this may be accomplished by various means. As a non-limiting example and as shown in FIGS. 2-6, the jet assembly 180 is secured, attached or coupled to or about the motor assembly 200 by the assistance of the mounting housing member 250.

As a non-limiting example and as best shown in FIGS. 5 and 6-18, the jet assembly 180 preferably includes: a jet assembly housing 181 that has a printed circuit board (PCB) 270 and a PCB cover 280; a shaft assembly 140; and an impeller 170. As an alternative, the jet assembly 180 may include: a jet assembly housing 181 that does not have the PCB 270 nor the PCB cover 280; a bearing and shaft assembly 100; and an impeller 170.

As shown in FIGS. 2-7, 10 and 14-16, the jet assembly housing 181 includes a base 182, a front or top cover 183, an impeller-receiving chamber 184 defined by the base 182 and front or top cover 183, a plurality of inlet apertures 185 dimensioned and configured to allow a fluid to enter the jet assembly housing 181 and preferably disposed about the central area of the front or top cover 183, and a plurality of outlet apertures 186 dimensioned and configured to allow the fluid to exit or be dispensed from the jet assembly housing into the basin 305,405 and preferably disposed about the periphery of the front or top cover 183.

As best shown in FIGS. 5, 10 and 14-16, the base 182 of the jet assembly housing 181 has an inner surface 191, an outer surface 192, a circular wall 193 at or about the periphery of the base 182, a plurality of feet extensions 198, and a plurality of engagement recesses or grooves 199. Preferably, the outer surface 192 is generally flat or has a generally flat, centrally-located section 557 that allows for a liner 290 to be positioned behind (or below) the base 182 of the jet assembly housing 181 and in front of (or above) the contact surface of the sidewall 306,406 of the basin 305,405, as shown in FIG. 4. The circular wall 193 has an inner surface 194, an outer surface 195, a front or top 196, and a rear or bottom 197. Each of the plurality of feet extensions 198 extends outwardly from about the rear or bottom 197 of the circular wall 193, and has a knob 299 extending rearwardly or downwardly from the corresponding feet extension 198 for engaging with the mounting housing member 250. Each of the plurality of engagement recesses or grooves 199 is positioned at a predetermined location about the outer surface 195 of the circular wall 193 for engaging with and securing the front or top cover 183. The base 182 may be made or manufactured of plastic, hard plastic, and/or any other suitable material known to one of ordinary skill in the art.

As best shown in FIGS. 2-7, 14 and 16, the front or top cover 183 of the jet assembly housing 181 has an inner surface 231, an outer surface 232, a circular wall 233 at or about the periphery of the front or top cover 183, a plurality of engagement protrusions 238, and a lock-receiving cavity 239. The circular wall 233 has an inner surface 234, an outer surface 235, a front or top 236, and a rear or bottom 237. Each of the plurality of engagement protrusions 238 is positioned at a predetermined location about the inner surface 234 of the circular wall 233 for engaging with a corresponding engagement recess or groove 199 of the base 182 such that the base 182 and front or top cover 183 may be detachably secured to one another prior to and during operation or use and also may be detachably unsecured from one another after operation or use for allowing access to the components, maintenance, etc. The front or top cover 183 may be made or manufactured of plastic, hard plastic, and/or any other suitable material known to one of ordinary skill in the art.

Preferably, the plurality of inlet apertures 185 form a diameter that is about equal to or smaller than the diameter of the impeller 170 so that there's a decreased chance of mixing between the inflow fluid and outflow fluid.

Preferably, each of the outlet apertures 186 has a nozzle. Preferably, each of the nozzles and an axis of the pump 10,300 form an angle less than 90 degree.

With the size and shape of the jet assembly 180 and the space between the inlet apertures 185 and outlet apertures 186 of the present invention, for optimizing the efficiency of the inflow of fluid and outflow of fluid, it is preferred that the distance between a lowest point of an inlet opening or aperture 185 to the highest point of the impeller 170 is less than an inch or half of an outer diameter of the impeller 170. In addition, it is preferred that a magnetic disc of impeller 170 is fully enclosed to prevent damage from chemicals and/or substances (such as, but not limited to, salt, acetone, and any chemical and/or substance known to one of ordinary skill in the art) that are used in the spa service industries, such as, but not limited to, the pedicure spa service industry.

As shown in FIG. 5, the PCB 270 of the jet assembly housing 181 has a "disc-like" configuration or shape, and includes a front or top side 271, a rear or bottom side 272, a hole 273, a plurality of inductive coils 274, and a light source 275, such as, but not limited to, a plurality of LED light members 275. The hole 273 allows the shaft member 150 to pass through, and is preferably centrally located. The plurality of inductive coils 274 are positioned at predetermined locations on the front or top side 271 proximate the hole 273. The plurality of LED light members 275 are positioned at predetermined locations on the front or top side 271 about the periphery of the PCB 270, and provide lighting or illumination to the jet assembly housing 181. The PCB 270 is secured or attached to the base 182 prior to operation or use such that the rear or bottom side 272 of the PCB 270 is adjacent or in close proximity to the inner surface 191 of the base 182. The PCB 270 may be secured or attached to the base 182 by any method known to one of ordinary skill in the art.

Preferably, the light source 275 is configured to emit a light that illuminates the first fluid when the magnetic pole array 177 of the impeller 170 is driven by the magnetic pole array 210,910 of the driven magnetic disc assembly 209, 900. The impeller 170 causes the first fluid to flow into the plurality of inlet apertures 185 and out the plurality of outlet apertures 186. Illuminating the first fluid via the light source 275 includes providing energy to the light source 275 via magnetic waves captured by the inductive coils 274, which are positioned between the impeller 170 and base 182 of the jet assembly housing 181. As a non-limiting example, the parameter of the illumination includes at least one of intensity, color, illumination sequencing, and any combination thereof.

As shown in FIG. 5, the PCB cover 280 of the jet assembly housing 181 has a "disc-like" configuration or shape, and includes a front or top side 281, a rear or bottom side 282, a hole 283, and a plurality of LED light member covers 285. The hole 283 allows the shaft member 150 to pass through, and is preferably centrally located. The plurality of LED light member covers 285 are positioned at predetermined locations on the front or top side 281 about the periphery of the PCB cover 280, and are adapted for being secured or attached with corresponding LED light members 275 of the PCB 270. The PCB cover 280 is positioned upon the PCB 270 such that the rear or bottom side 282 of the PCB cover 280 is adjacent or in close proximity to the front or top side 271 of the PCB 270.

As best shown in FIGS. 8-14, the bearing and shaft assembly 100 is comprised of a bearing assembly 110 comprising an outer bearing member 120 and an inner bearing member 130, and a shaft assembly 140 comprising a shaft member 150, a shaft protection member 160, and a locking member 159.

As shown in FIGS. 11-14, the outer bearing member 120 and inner bearing member 130 perform as a bearing. The inner bearing member 130 absorbs vibration and noise when in use with other components of the jet assembly 180.

Figure 13:
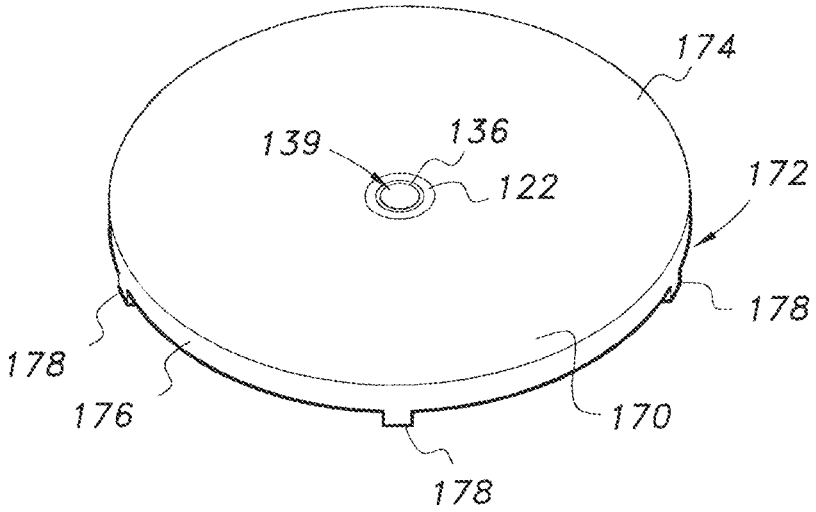
FIG. 13 is an assembly, perspective view of the bearing assembly of FIG. 11 positioned within a cavity of an impeller.
Figure 14:
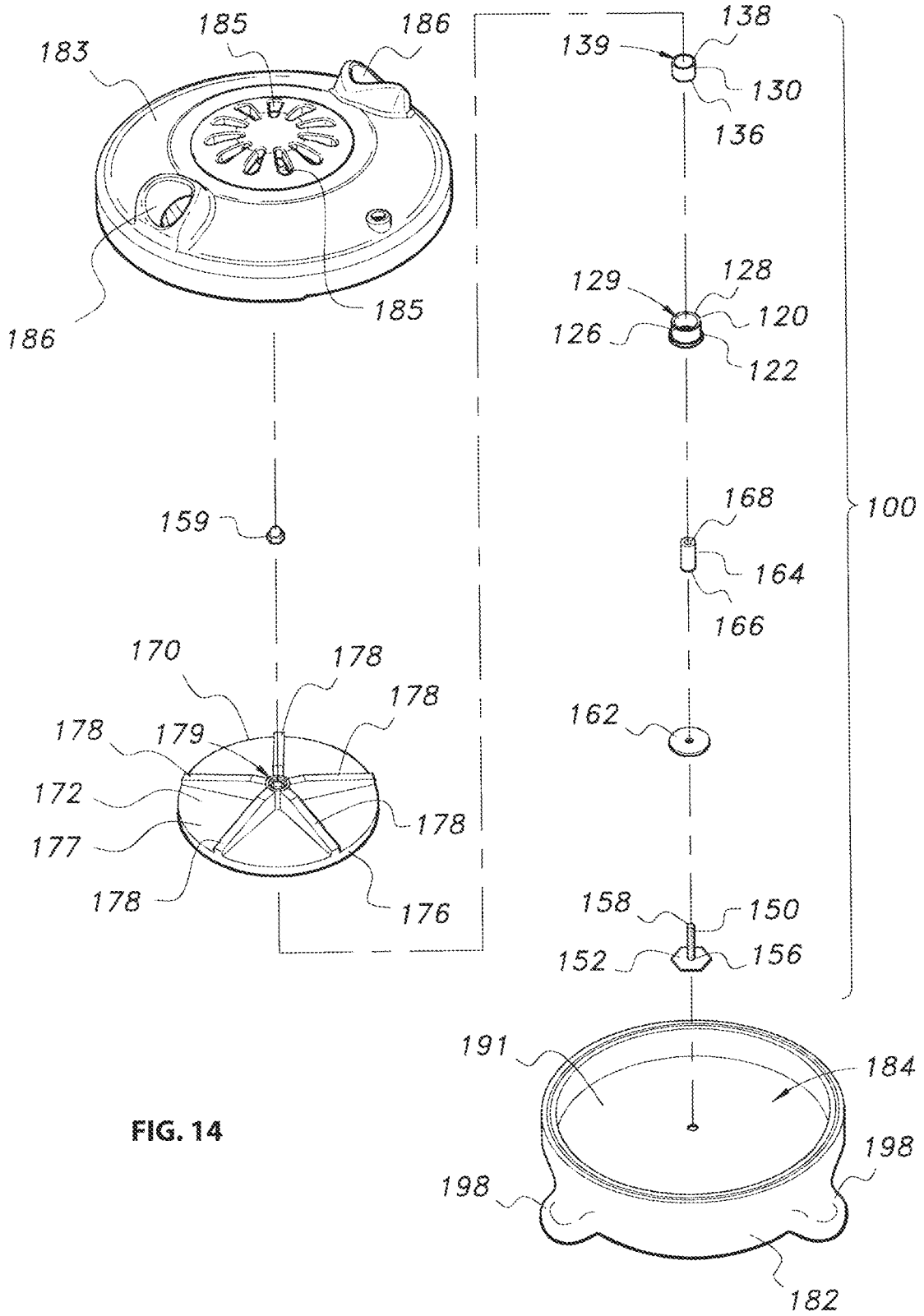
FIG. 14 is an exploded, perspective view of the bearing assembly of FIG. 10, the shaft assembly of FIG. 8, and a jet assembly (with a front or top cover)

The outer bearing member 120 includes a base 122, preferably a ring-like base, and a cylindrical body 124 extending upwardly from the ring-like base 122. The ring-like base 122 has a predetermined thickness. The cylindrical body 124 has a first end 126, a second end 128, and a cavity 129 extending from the first end 126 to the second end 128. As shown in FIGS. 11-14, the cavity 129 is dimensioned and configured for receiving the inner bearing member 130. Preferably, when in use, the outer bearing member 120 and inner bearing member 130 are closely or tightly positioned relative to one another such that they form an effective seal. As shown in FIGS. 13 and 14, the outer bearing member 120 is dimensioned and configured for fitting, preferably closely or tightly fitting, within a centrally-disposed cavity 179 of the impeller 170, preferably a magnetic impeller and more preferably a planar magnetic impeller, of the jet assembly 180. Preferably and as best shown in FIG. 13, the ring-like base 122 of the outer bearing member 120 and first end 136 of the cylindrical body 134 of the inner bearing member 130 are substantially flush with the rear side 174 of the magnetic impeller 170 when the outer bearing member 120 and inner bearing member 130 are positioned within the centrally-disposed cavity 179 of the magnetic impeller 170. Preferably, the centrally-disposed cavity 179 of the magnetic impeller 170 is dimensioned and configured for effectively receiving the bearing assembly 110 prior to use, and also for effectively retaining the bearing assembly 110 when in use. The outer bearing member 120 is preferably made or manufactured of a plastic material or engineered plastics. It is obvious to one of ordinary skill in the art that other suitable materials may be used in the making or manufacturing of the outer bearing member 120.

The inner bearing member 130 includes cylindrical body 134 having first end 136, a second end 138, and a cavity 139 extending from the first end 136 to the second end 138. As shown in FIGS. 11-14, the cavity 139 is dimensioned and configured for receiving the shaft member 150 and shaft protection member 160 of the shaft assembly 140. The inner bearing member 130 is preferably made or manufactured of rubber or a rubber-like material. It is obvious to one of ordinary skill in the art that other suitable materials may be used in the making or manufacturing of the inner bearing member 130.

Figure 9:
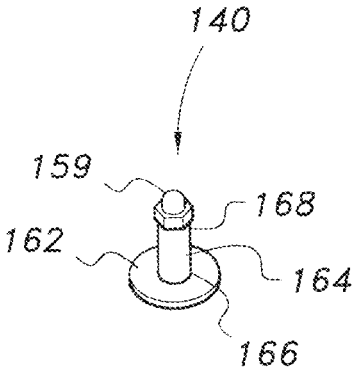
FIG. 9 is an assembly, perspective view of the shaft assembly of FIG. 8.
Figure 10:
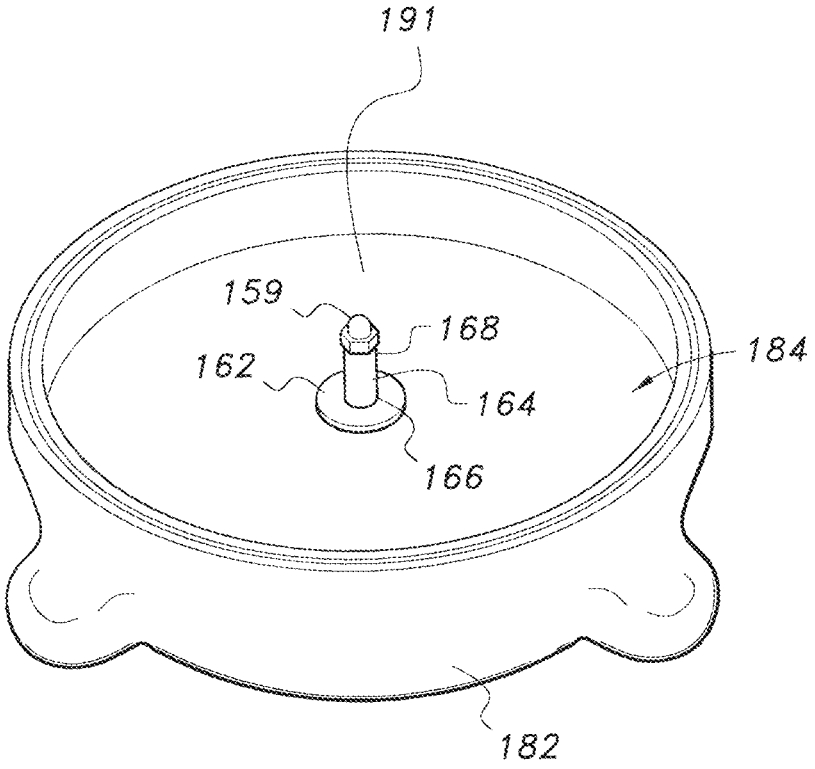
FIG. 10 is an assembly, perspective view of the shaft assembly of FIG. 8 positioned relative to a jet assembly housing (without a front or top cover) of a jet assembly.
Figure 11:
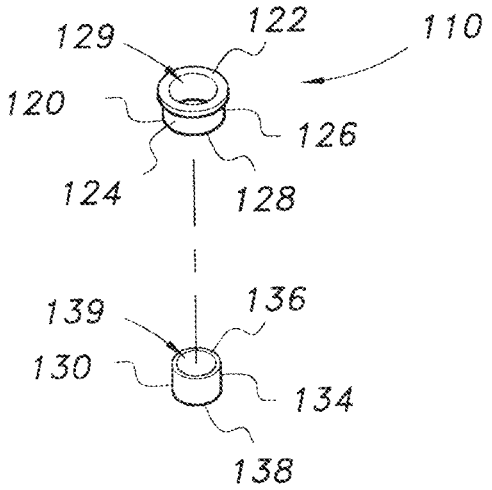
FIG. 11 is an exploded, perspective view of a bearing assembly of a bearing and shaft assembly according to the present invention.
Figure 12:
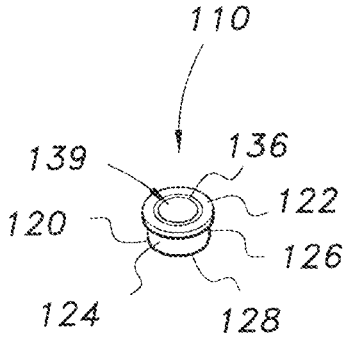
FIG. 12 is an assembly, perspective view of the bearing assembly of FIG. 11.

As shown in FIGS. 8-10 and 14, the shaft member 150 includes a base 152 and a cylindrical body 154 extending upwardly from the base 152. The cylindrical body 154 has a first end 156 and a second end 158. As best shown in FIG. 9, the shaft member 150 and shaft protection member 160 are secured, attached, fixed or mounted within the housing 181, preferably in a central location upon the inner surface 191 of the base 182 of the housing 181, of the jet assembly 180 via the base 152 of the shaft member 150 being secured, attached, fixed or mounted to the base 182 of the housing 181. The cylindrical body 154 has a first end 156 and a second end 158. The shaft member 150 is preferably made or manufactured of steel or a metal material. It is obvious to one of ordinary skill in the art that other suitable materials may be used in the making or manufacturing of the shaft member 150. Also, the shaft member 150 is preferably made or manufactured as a single piece. It is obvious to one of ordinary skill in the art that the shaft member 150 may be made or manufactured as multiple pieces.

Figure 7:
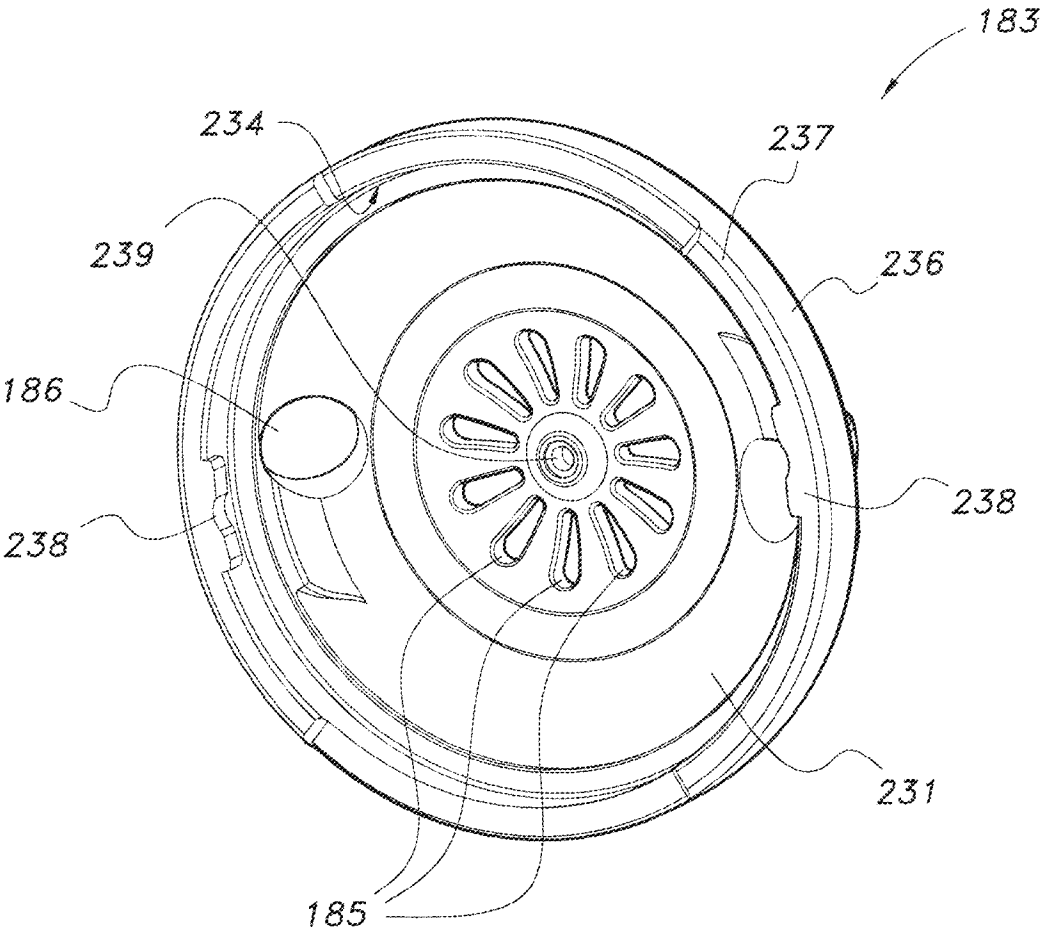
FIG. 7 is a rear, perspective view of a front or top cover of a jet assembly housing according to the present invention, showing an inner surface of the front or top cover.
Figure 8:
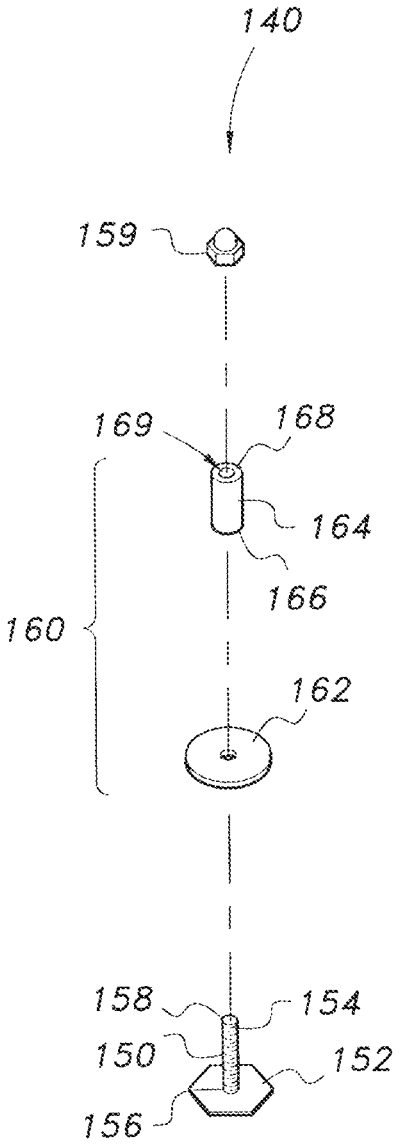
FIG. 8 is an exploded, perspective view of a shaft assembly according to the present invention.

The shaft protection member 160 includes a base 162, preferably a ring-like base, and a cylindrical body 164 extending upwardly from the ring-like base 162. The cylindrical body 164 has a first end 166, a second end 168, and a cavity 169 extending from the first end 166 to the second end 168. As shown in FIG. 7, the cavity 169 is dimensioned and configured for receiving the cylindrical body 154 of the shaft member 150. The shaft protection member 160 is preferably made or manufactured of a hard material, such as ceramic or a ceramic-type material. It is obvious to one of ordinary skill in the art that other suitable materials may be used in the making or manufacturing of the shaft protection member 160. Also, the shaft protection member 160 is preferably polished or super smooth on its outer surface. Further, the shaft protection member 160 is preferably made or manufactured as two pieces. It is obvious to one of ordinary skill in the art that the shaft protection member 160 may be made or manufactured as a single piece.

The locking member 159 secures the shaft protection member 160 to the shaft member 150. The locking member 159 may be a locking nut that, when in use, is secured onto the second end 158 of the cylindrical body 154 of the shaft member 150.

Figure 17:
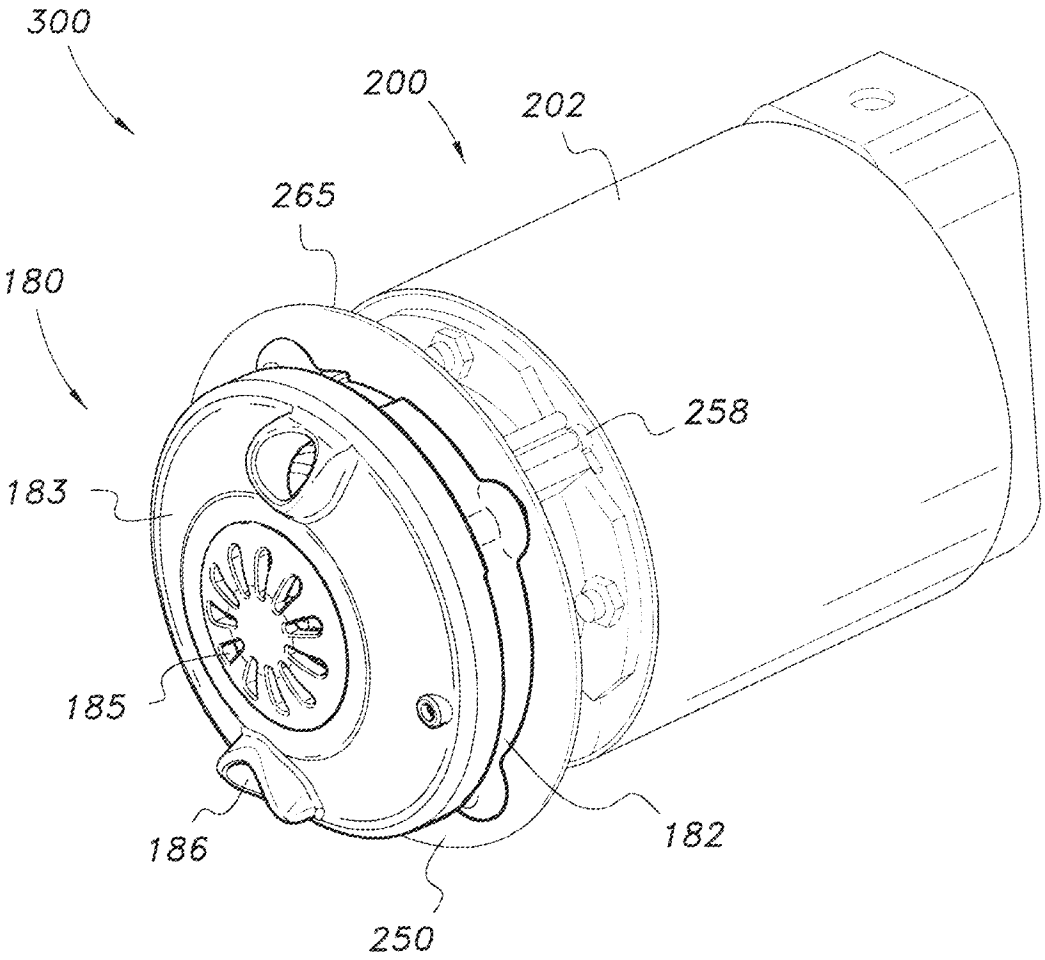
FIG. 17 is a perspective view of a magnetic coupling-type fluid pump according to the present invention, showing a jet assembly and a motor assembly secured or coupled to or about one another.

In addition, when the magnetic coupling-type fluid pump 300 is assembled as shown in FIGS. 17 and 18, the jet assembly 180 is positioned adjacent or in close proximity to the mounting housing member 250 and motor assembly 200. The jet assembly 180 is preferably magnetically coupled to the motor assembly 200 when the jet assembly 180 is positioned adjacent or in close proximity to the mounting housing member 250. The jet assembly 180 and mounting housing member 250 can be secured or coupled to one another by any method and/or device known to one of ordinary skill in the art.

In operation or use and as shown in FIGS. 5 and 10-14, the base 152 of the shaft member 150 and base 162 of the shaft protection member 160 may be secured, attached, fixed or mounted preferably in a central location upon the inner surface 191 of the base 182 of the housing 181 of the jet assembly 180 of the magnetic coupling-type fluid pump 10,300. The bearing assembly 110 may then be positioned in the cavity 179 of the magnetic impeller 170, which can then be positioned within the impeller-receiving chamber 184 of the housing 181 of the jet assembly 180. The locking member or nut 159 can then be secured to the second end 158 of the cylindrical body 154 of the shaft member 150 to secure the magnetic impeller 170 within the housing 181 of the jet assembly 180.

Preferably when in operation or use and as shown in FIGS. 17 and 18, the jet assembly 180 is positioned adjacent or in close proximity to the motor assembly 200 when the magnetic coupling-type fluid pump 10,300 is fully assembled. In that regard, the jet assembly 180 is preferably magnetically coupled to the motor assembly 200 when the jet assembly 180 is positioned adjacent or in close proximity to the motor assembly 200. Specifically, the magnetic pole array 210 of the driven magnetic disc assembly 209 and the magnetic pole array 177 of the impeller 170 magnetically couple together the motor assembly 200 and the jet assembly 180.

Moreover, during operation of the motor assembly 200, the shaft member 150 is preferably stationary and the magnetic field 212 generated by the magnetic pole array 210 of the driven magnetic disc assembly 209 moves or fluctuates in accordance with the rotation of the magnetic pole array 210 of the driven magnetic disc assembly 209. This moving or fluctuating magnetic field 212 moves and/or causes rotation of magnetic pole array 177 of the magnetic impeller 170. Additionally, as discussed in greater detail below, rotation of the magnetic impeller 170 results in fluid being drawn towards the magnetic impeller 170 through inlet apertures 185 and such fluid to be propelled out of the jet assembly 180 through the outlet aperture 186.

Figure 15:
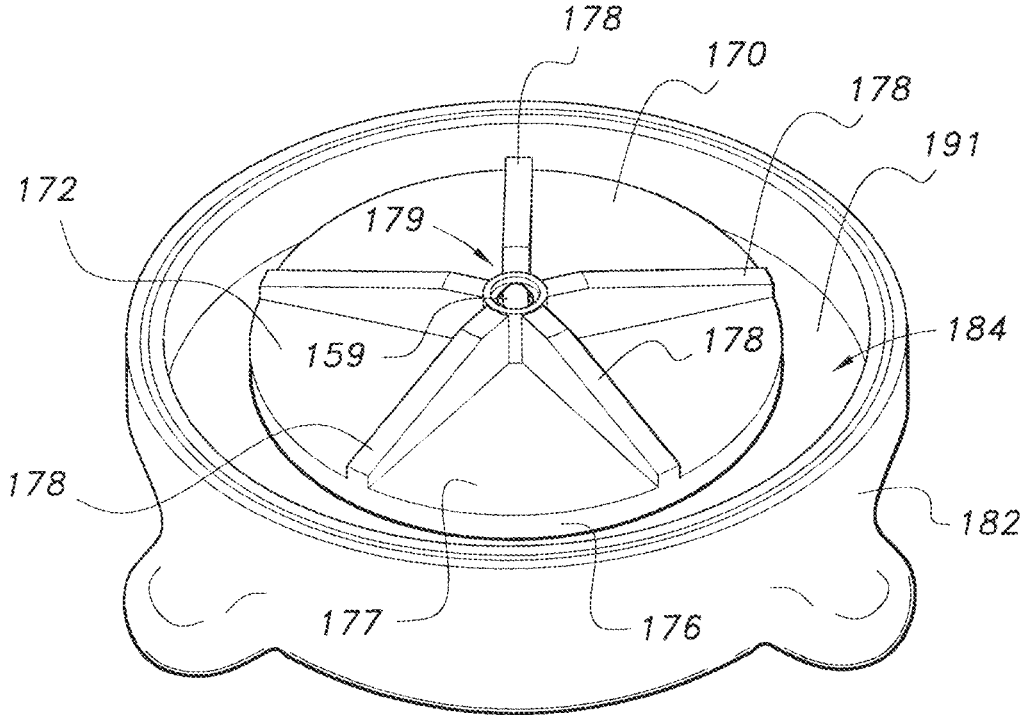
FIG. 15 is an assembly, perspective view of the bearing and shaft assembly of FIGS. 8 and 11, and the impeller and jet assembly housing of the jet assembly (without the front or top cover) of FIG. 14.
Figure 16:
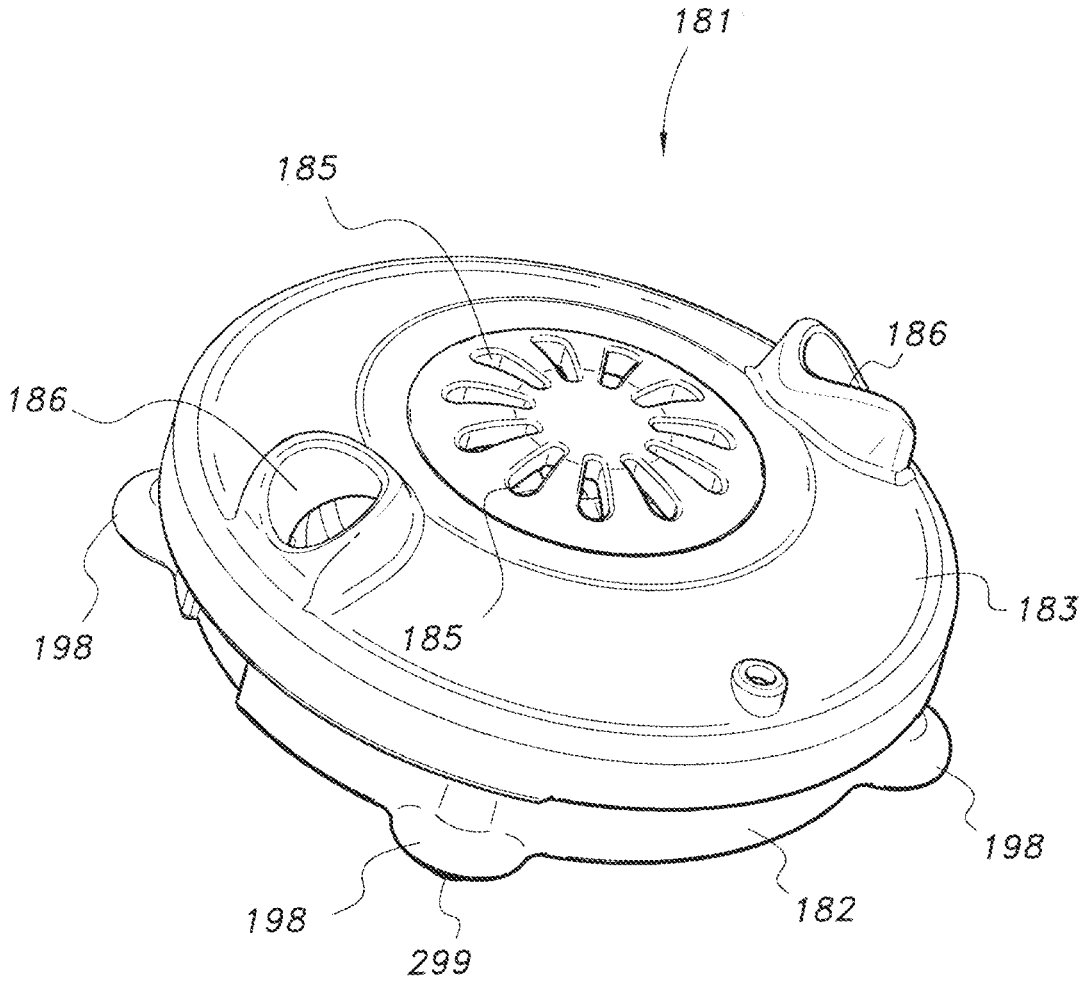
FIG. 16 is an assembly, perspective view of the bearing and shaft assembly of FIGS. 8 and 11, and the impeller and jet assembly housing of the jet assembly (with the front or top cover) of FIG. 14.

As shown in FIGS. 5, 14 and 15, the impeller 170, preferably a magnetic impeller 170 and more preferably a planar magnetic impeller 170, has an outer diameter and a "disc-like" configuration or shape, and includes a front side 172, a rear side 174, a sidewall 176, a circular array of arm members 178 positioned on the front side 172, and the centrally-disposed cavity 179 dimensioned and configured for receiving the outer bearing member 120, inner bearing member 130, shaft member 150, and shaft protection member 160. The centrally-disposed cavity 179 preferably extends from the front side 172 through to the rear side 174. The magnetic impeller 170 is configured to rotate about the shaft member 150 and shaft protection member 160 and to rotate within the impeller-receiving chamber 184. Preferably, the magnetic impeller 170 is formed in whole or in part of a magnetic pole array 177 that, as discussed below, interacts with magnetic pole array 210 of the driven magnetic disc assembly 209 to rotate the magnetic impeller 170 about the shaft member 150 and shaft protection member 160 such that rotation of the magnetic impeller 170 causes the fluid to flow into the inlet aperture 185 and out the outlet aperture 186. As a non-limiting example, the magnetic impeller 170 may contain a magnetic plate or disk that is preferably substantially or fully enclosed within an exterior preferably made or manufactured of plastic, rubber, a rubber-like material, or any combination thereof. It is obvious to one of ordinary skill in the art that the magnetic impeller 170 may be other types of magnetic impellers that is know in the art. In addition, it is obvious to one of ordinary skill in the art that the exterior of the magnetic impeller 170 may be made or manufactured of any material that is know in the art.

When the top cover 183 of the jet assembly housing 181 is secured to the base 182, it is preferred in a non-limiting example that the vertical distance from a highest point of the impeller arm members 178 to the lowest inlet aperture 185 on the inner surface of the top cover 183 is less than or equal to about half of an inch.

Figure 18A:
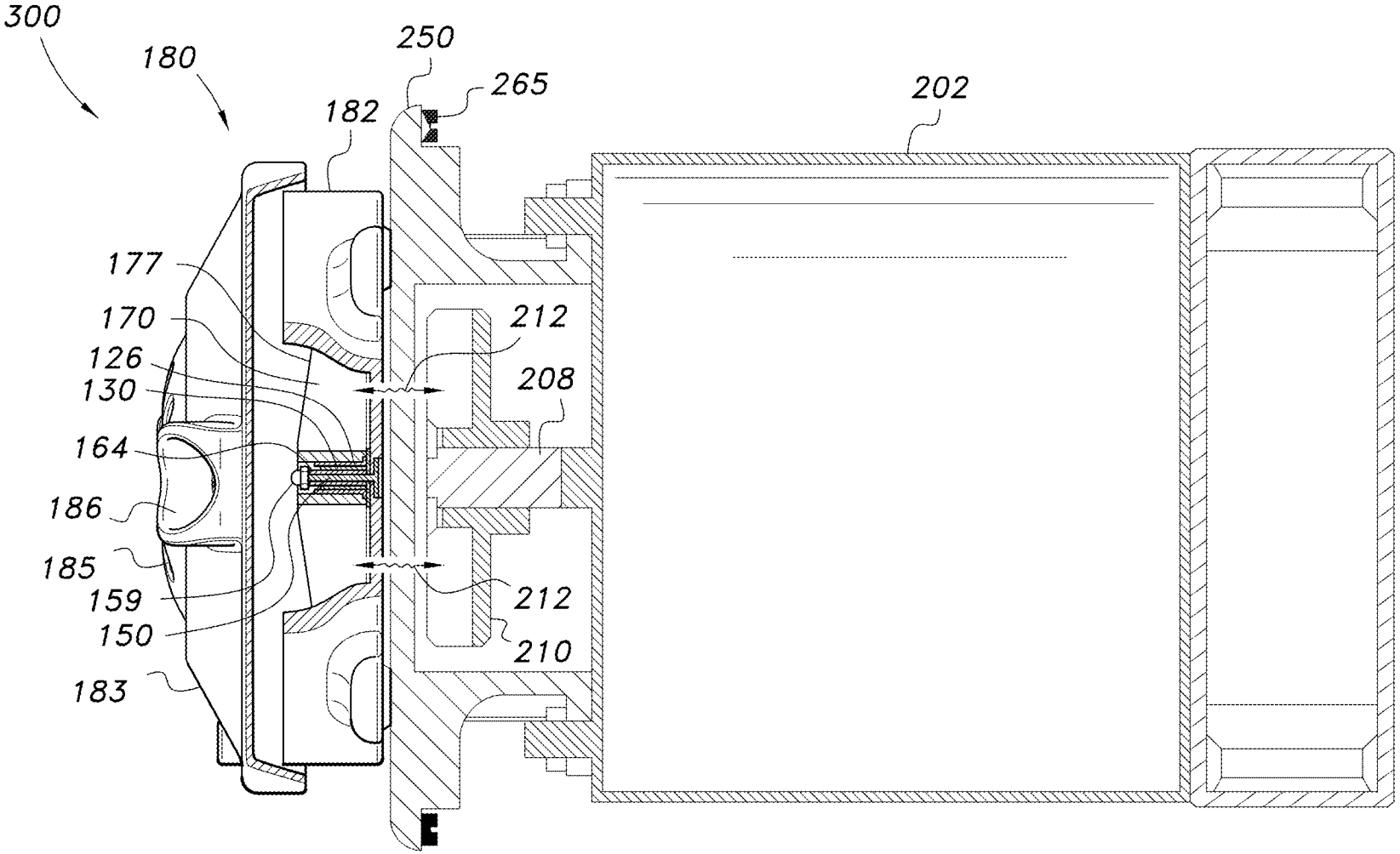
FIG. 18A is a cross-sectional view of the magnetic coupling-type fluid pump of FIG. 17.
Figure 18B:
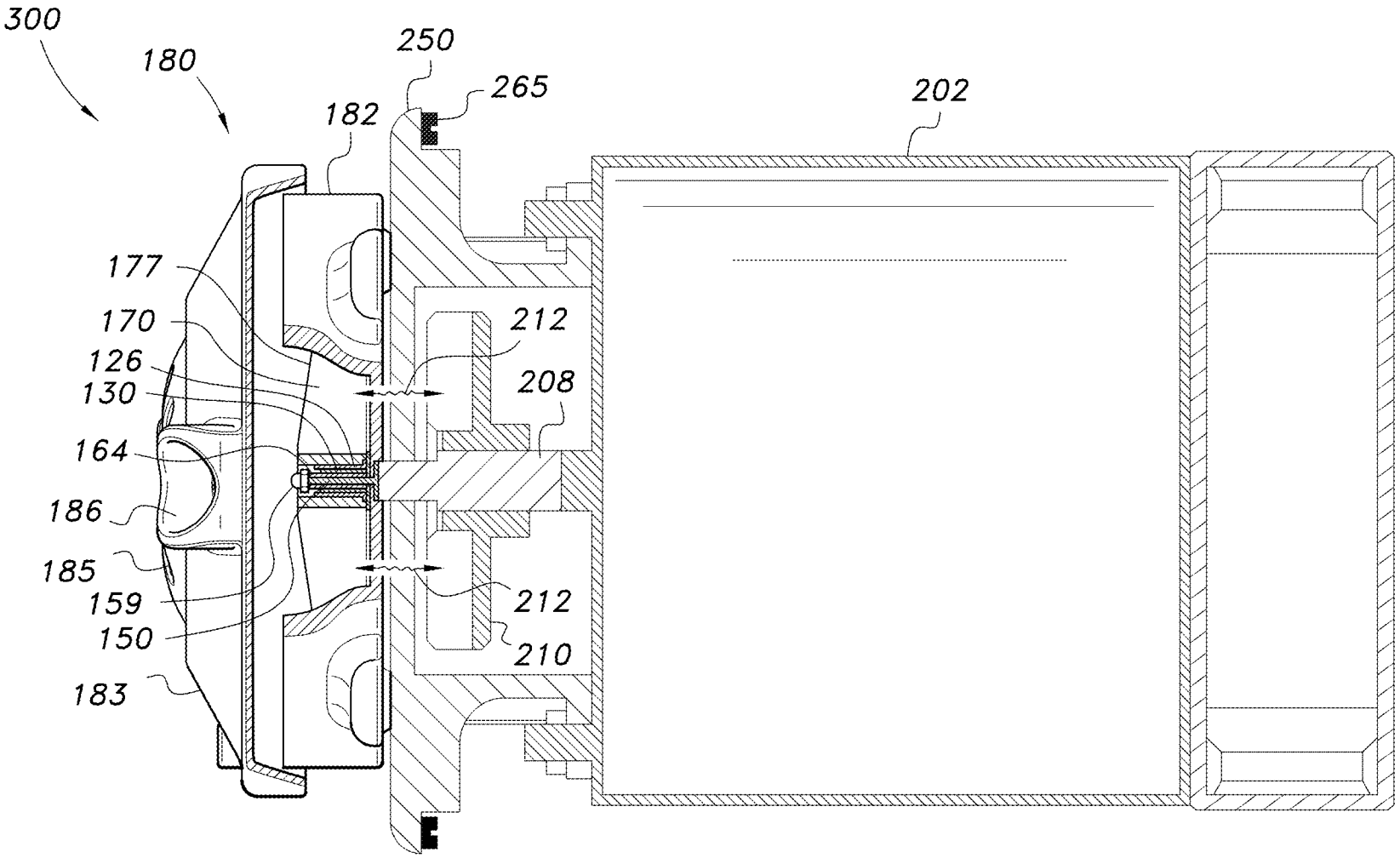
FIG. 18B is a cross-sectional view of another embodiment of a magnetic, coupling-type pump according to the present invention, showing a jet assembly and a motor assembly secured or coupled to or about one another.

As best shown in FIGS. 18A and 18B, the motor assembly 200 includes a motor 202, a magnetic pole array 210 such that the motor 202 is configured to drive the magnetic pole array 210, a mounting housing member 250, a gasket 265, a motor shaft member 208 that is coupled to the magnetic pole array 210, and a plurality of screws with wing nuts 258 to support the pump mounting. The mounting housing member 250 and gasket 265 preferably enclose all or a substantial portion of the magnetic pole array 210, and help to keep fluids and/or substances away from the motor 202 and magnetic pole array 210 so that contamination and/or damage is reduced or prevented. The magnetic pole array 210 is formed of magnetic material and/or is magnetized in order to generate a magnetic field 212. As shown in FIG. 18A, the motor shaft member 208 preferably does not extend through the mounting housing member 250. Alternatively, as shown in FIG. 18B, the motor shaft member 208 extends through the mounting housing member 250.

In that regard, the motor assembly 200 may include and/or be coupled to a power source (not shown) that enables rotation of the motor shaft member 208 and magnetic impeller 170. Upon operation of the motor assembly 200, the motor shaft member 208 is rotated such that the magnetic field 212 generated by the magnetic pole array 210 moves or fluctuates in accordance with the rotation of the magnetic pole array 210.

Furthermore, the motor assembly 200 may further include an air channel (not shown), or air channel member (not shown). In that regard, the air channel includes an inlet (not shown) and outlet (not shown). The air channel, in part, enables the jet assembly 180 to produce a jet stream of fluid that includes an air mixture.

As a non-limiting example and as best shown in FIG. 4, the liner 290, preferably a disposable liner 290, may be included with the pump 10 or may be provided by an operator or user of the spa tub 5. The liner 290 is positioned between the base 182 of the jet assembly housing 181 and the mounting housing member 250. The liner 290 helps to provide proper or adequate hygiene for customers or users. Preferably, the disposable liner 290 is made or manufactured of a plastic material or any other material known to one of ordinary skill in the art. If the liner 290 is not a disposable version, then it is preferred that the liner 290 is made or manufactured of a material that is easily washed or cleaned, or any other material known to one of ordinary skill in the art.

As a non-limiting example and as best shown in FIGS. 1 and 27A-33, the sprayer 500,550 with a thermal meter or gauge 510,560 preferably includes an inlet 512,562, an outlet 514,564, a sprayer on/off or volume control 516,566, a thermal meter or gauge 510,560, and a backflow preventer 518,568. The thermal meter or gauge 510,560 may be a digital thermal meter or gauge 510, an analog thermal meter or gauge 560, or any thermal meter or gauge known to one of ordinary skill in the art. Preferably, the sprayer 500 with a digital thermal meter or gauge 510 also includes an electric generator 520. The digital thermal meter or gauge 510 is preferably secured into the sprayer 500, and may include a PCB and electronic components (not shown) to allow it to effectively measure and display the temperature of the water and/or fluids. The electric generator 520 may include an impeller 522, a magnet 523, and coiled copper wire 524, or may be any electric generator known to one of ordinary skill in the art. The analog thermal meter or gauge 560 is preferably secured into the sprayer 550 via a portion having threads 567, and may include mechanical components (such as a temperature sensor 569) to allow it to effectively measure and display the temperature of the water and/or fluids. The backflow preventer 518,568 prevents water and/or fluids to flow back into the sprayer 500,550 at about the outlet 514,564.

During use or operation, the worker or employee (or user if allowed to do so) can use the thermal meter or gauge 510,560, instead of touching the water and/or fluids that may be present in or is entering the basin 305,405, to estimate or check on the temperature of the water and/or fluids prior to filling the basin 305,405 through the sprayer's outlet 514, 564 with the water and/or fluids from the inlet 512,562 that has reached the desired or proper temperature for usage. To be sanitary and also to confirm that the water and/or fluids has reached the desired or proper temperature for usage, the worker or employee may also spray some water and/or fluids through the sprayer's outlet 514,564 to or into the worker's or employee's hand(s) that are positioned outside of the basin 305,405.

As shown in FIGS. 19, 25A, 25B and 25C, the air pump assembly 601 is designed and configured to be mounted to the sidewall 406 of a basin 405 for providing air massage therapy to a user.

Figure 19:
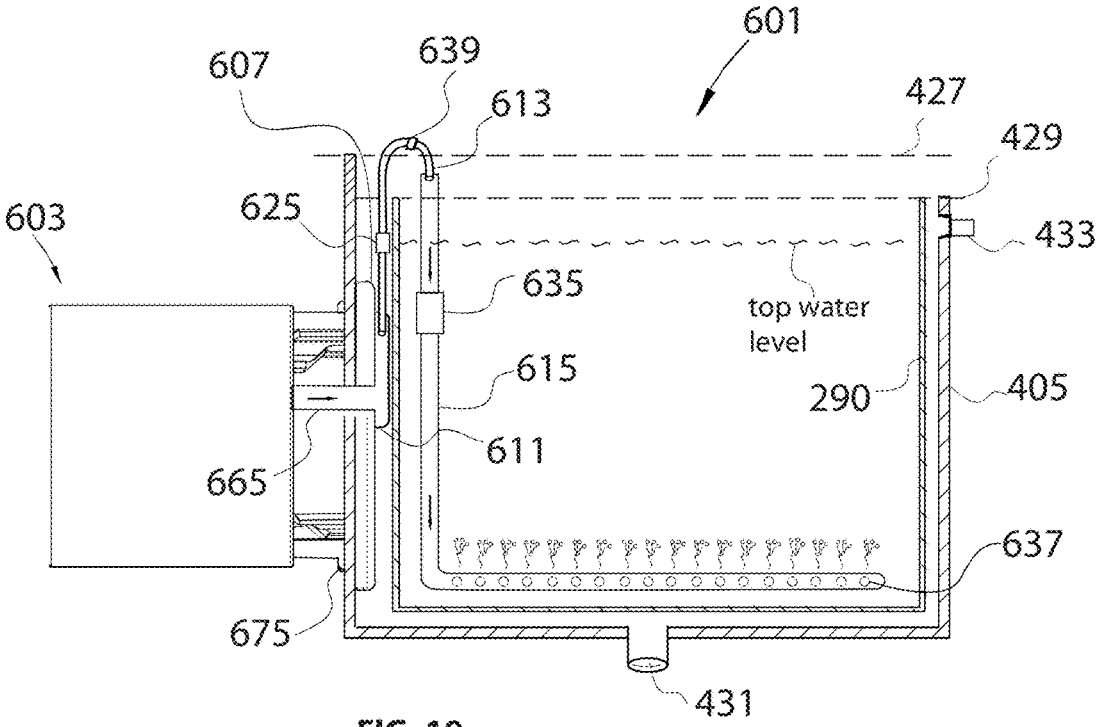
FIG. 19 is a right side, partial cross-sectional view of an air pump assembly according to the present invention, showing a pump secured to or proximate to a setting, such as an internal wall of a foot spa, while an air nozzle extends into a liner positioned in a foot basin.
Figure 20:
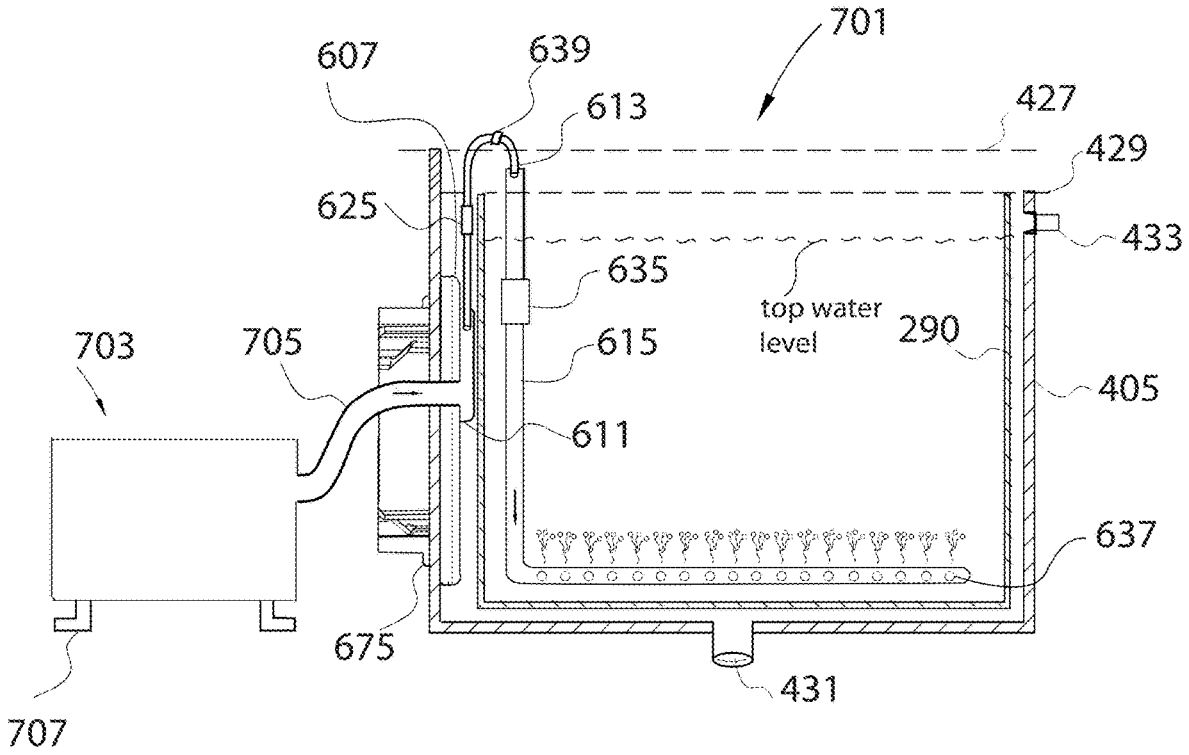
FIG. 20 is a right side view of an alternate embodiment of an air pump assembly of FIG. 19.

Referring now to FIGS. 19 and 20, a right side, partial cross-sectional, environmental view of a pump 603 and pump assembly 601 according to the present application is illustrated. In the applicable figures, pump 603 is secured to or proximate to a basin 405, such as an external/internal sidewall 406 of a foot spa 405, while an air nozzle extends over and into a disposable liner 290 positioned in a foot basin 405. Air is dispersed in the water through the disposable air dispenser 615. Basin 405 is not meant to be limited to a foot spa only but may also be a spa, a manicure spa, a jacuzzi, a bathtub, or a swimming pool for example.

As seen in FIG. 19, assembly 601 includes air pump 603 coupled to foot basin 405 through the use of an air pump mounting housing member 607. Mounting housing member 607 includes a passageway for the traveling of air through a nozzle adapter 611 wherein an air nozzle 613 routes air to an air dispenser 615 for dispersion into the water. Dispenser 615 is located within liner 290 and is submerged within the water.

As seen in FIG. 20, an alternate embodiment of pump assembly 701 is shown. In FIG. 20, pump assembly 701 is shown in a similar manner as pump assembly 601. Assembly 701 is similar in form and function to assembly 601 except as herein identified wherein pump 603 is configured to instead be operative remotely from basin 405. Pump 703 is similar in form and function to pump 603 and is operated remotely by extending an air tube 705 between mounting housing member 607 and pump 703. Pump 703 may then include one or more mounting legs 707. The remote operation of pump 703 allows it to be useful in working with multiple styled basins, baths, containers, and so forth outside the realm of mainstream foot spas. The disclosure of assembly 601 will apply equally to that of assembly 701 in FIG. 20.

Figure 21:
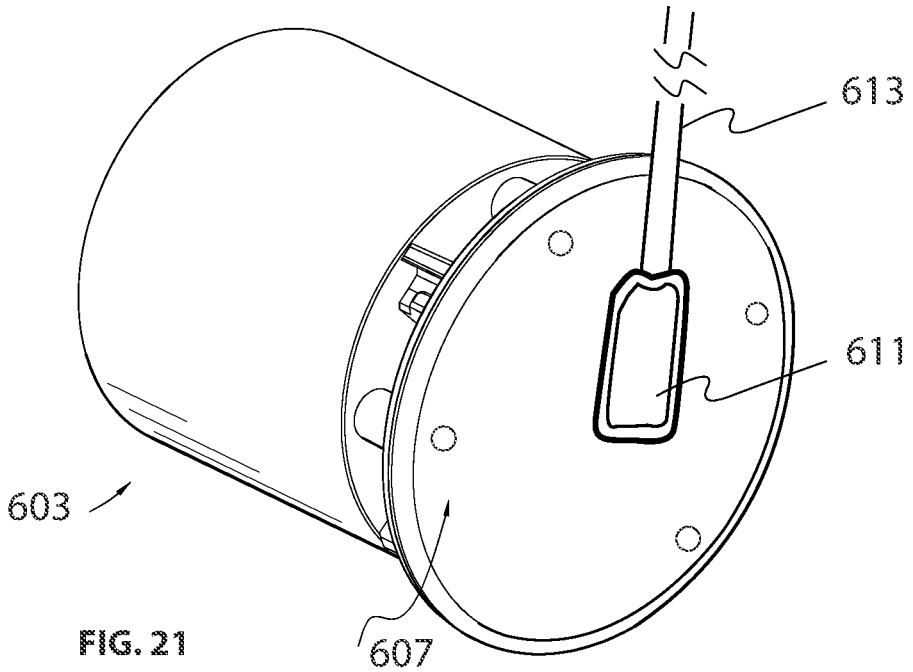
FIG. 21 is a front perspective view of an air pump in the pump assembly of FIG. 19.
Figure 22:
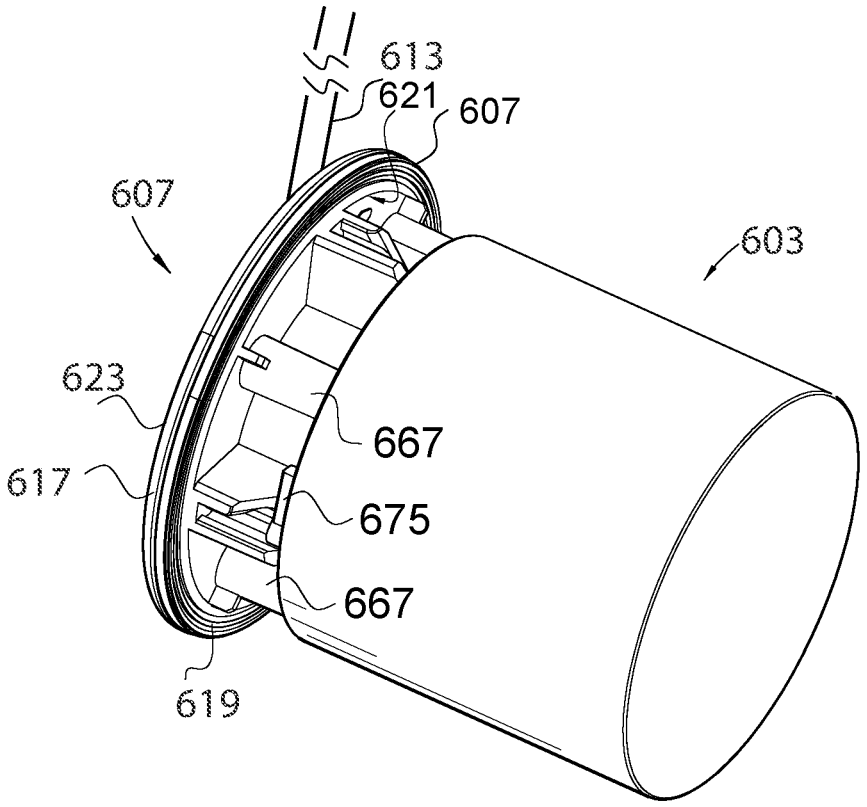
FIG. 22 is a rear perspective view of the air pump of FIG. 21.

Referring now also to FIGS. 21 and 22, front and rear perspective views of pump 603 are illustrated. Mounting housing member 607 is configured to provide an attachment point for pump 603 on a side wall of basin 405. Mounting housing member 607 includes a shoulder 617 located at an outer most portion of a flange that extends radially outward to a circumference larger than pump 603. Shoulder 617 is located internally within basin 405 when fully assembled with the main body of mounting housing member 607 passing through an aperture in basin 405 for connection with pump 603.

A seal 619 is located along a bottom surface 621 of mounting housing member 607. Seal 619 creates an air tight and water tight seal between mounting housing member 607 and basin 605 so as to prevent any leak which may develop. Seal 619 is preferably a ring-shaped or ring-type gasket which acts or serves as a fluid or water seal to prevent fluid or water from getting past the contact surface of basin 605. Seal 619 is secured to and positioned below (or behind) and adjacent to the rear or bottom side 621 of the mounting housing member 607. Preferably, the gasket seal 619 is made or manufactured of a rubber material.

As seen in FIG. 21, a front view of mounting housing member 607 is shown. Mounting housing member 607 has a top surface 623 (front face) opposite bottom surface 621. Air nozzle adapter 611 is coupled to top surface 623. Air nozzle 613 extends outward from adapter 611. Air leaving pump 603 passes through mounting housing member 607, through adapter 611 and into nozzle 613. In FIG. 19, a side view is partially sectioned to show adapter 611 and nozzle 613. An air nozzle extension 625 is optionally used to help in lengthening nozzle 613 so as to adapt to size and fit requirements of basin 405. Nozzle extension 625 is a tubular member that extends over ends of nozzle 613 where nozzle 613 is composed of two or more distinct tubes. The length of nozzle extension 625 is not limited to any particular length, only that it is sized according to the needs at the time of use.

From FIGS. 19 and 20, it is seen that nozzle 613 extends up and over liner 290, preferably a disposable liner. Liner 290 is a device that is sized similarly to that of basin 405 and is used as a disposable protector to hold a quantity of water. Liner 290 helps to provide proper or adequate hygiene for customers or users. Preferably, the disposable liner 290 is made or manufactured of a plastic material or any other material known to one of ordinary skill in the art. If the liner 290 is not a disposable version, then it is preferred that the liner 290 is made or manufactured of a material that is easily washed or cleaned, or any other material known to one of ordinary skill in the art.

During use, a user would place a portion of their body in basin 405, and in particular within liner 290, where it would be partially submerged in a volume of water or liquid. When the user is done, the water could be drained and the liner may be removed and discarded. Basin 405 may then receive a secondary or replacement liner in place of the one just used. In this manner, the liners help maintain sanitary practices wherein multiple users are realized. As a non-limiting example, the liner 290 may be included with the air dispenser 615.

Referring now also to FIG. 26, a perspective view of basin 405 is illustrated. Basin 405 is made from any known conventional material sufficient to support a volume of water. Basin 405 includes a plurality of sidewalls 406 and a base 408 that are each coupled or formed together to define a volume. Basin 405 includes a top rim 427 defining an upper level of water and a lower rim 429 defining a lower level of water. Lower rim 429 is formed on one side, but is able to be formed on multiple sides if necessary. Liner 290 resides within the volume of space within basin 405. Ideally, liner 290 is of a height equal to lower rim 629. Liner 290 may be other heights between lower rim 629 and upper rim 627. Water and/or fluids is filled inside of liner 290. As a user inserts a portion of their body into the volume of water and/or fluids, water and/or fluids may overflow liner 290. Overflow may pass between liner 290 and basin 405 and flow down to drain hole 431 where it drains away from basin 405. A connector may be coupled to hole 431 for communication with a drainage system. As an option, an over flow preventer mounting hole 433 may be included on basin 405. Water and/or fluids would be routed through hole 433 if the water and/or fluids level got too high and hole 431 was not either operable or included with basin 405.

Figure 25A:
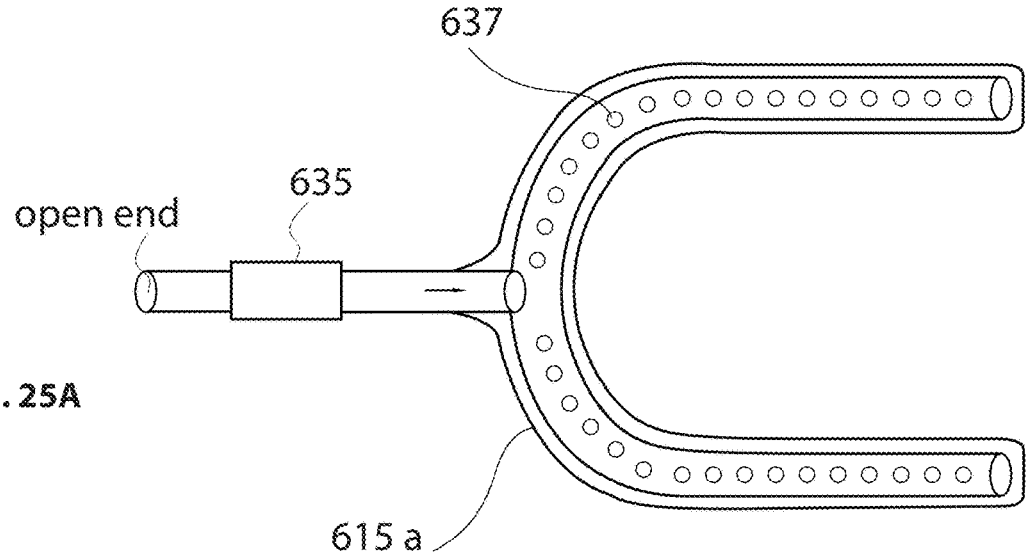
FIGS. 25A-25C are top views of exemplary air dispensers for use with the air pump assembly of FIG. 19.
Figure 25B:
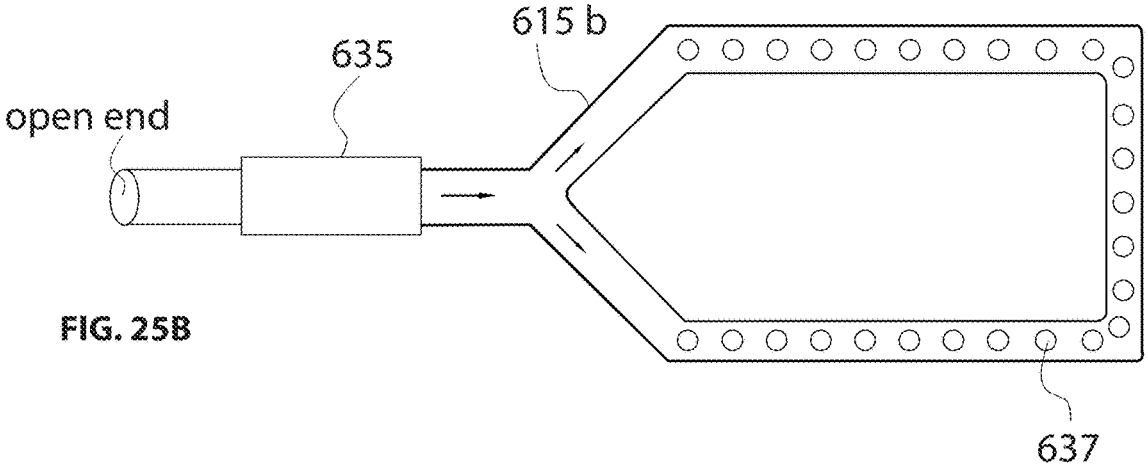
Figure 25C:
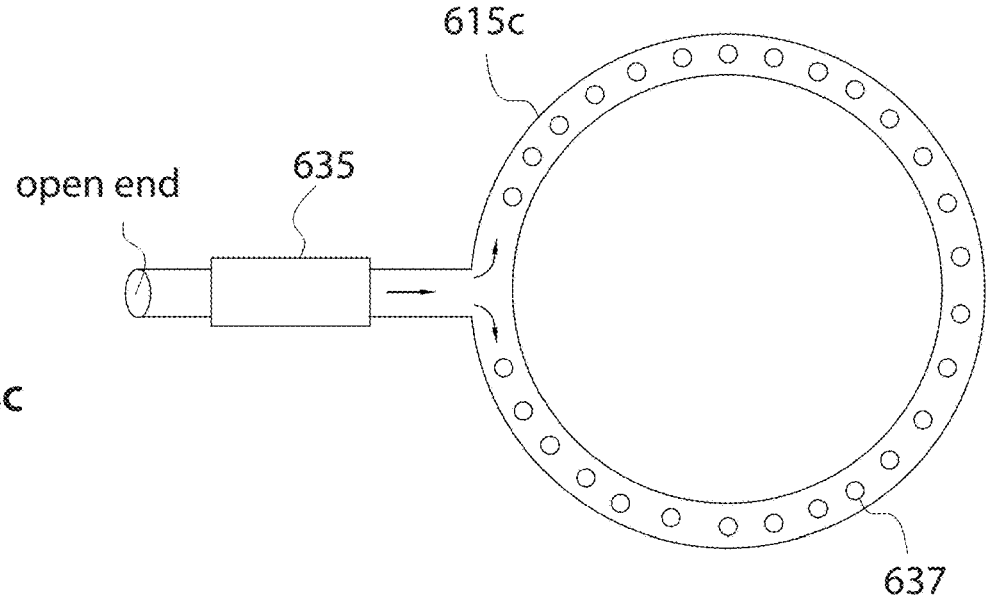

Referring now also to FIGS. 25A-25C, top views of exemplary embodiments of air dispenser 615 are illustrated. Dispenser 615 extends into liner 290 from the end of air nozzle 613. As the size and depth of liner 290 and basin 405 may be different, assembly 601 may include an air dispenser extension 635. Extension 635 is similar in form and function to that of extension 625 for use with nozzle 613. Air passes through nozzle 613 and into dispenser 615. The communication point between nozzle 613 and dispenser 615 is ideally above the water lever in liner 290. This helps to prevent water from breaching any connection thereat. As seen in FIGS. 19 and 20, the connection point between the two may be between rims 427 and 429. In another embodiment, the connection point may be above rim 427.

Dispenser 615 includes a series of air holes or ports 637 configured to dispense air. The profile or layout of dispenser 615 may vary and can dictate a particular distribution pattern in liner 290. As seen in FIGS. 25A-25C, different embodiments of dispenser 615 are illustrated, each having a different distribution pattern. With respect to FIG. 25A, dispenser 615*a* is shown wherein the air is routed to two separate appendages which are formed in the shape of a "U". The main line of dispenser 615*a* is at the base of the "U" shape permitting air to travel to either appendage. In FIG. 25B, dispenser 615*b* is shown wherein the air is routed to two appendages that are formed into a rectangular loop. The air in each appendage is communicable with the air in the other appendage. For FIG. 25C, dispenser 615*c* is shown in a similar nature to that of dispenser 615*b* wherein a loop is formed. Dispenser 615*c* differs in that the loop formed is circular as opposed to rectangular as seen in FIG. 25B. From the figures, dispenser 615 may include a plurality of appendages and incorporate different shapes to generate a fully looped air system or one or more closed appendages. Dispenser 615 is not limited to these depicted embodiments but may take other forms including a linear single appendage routing. It is recognized that the inner surface of the base of basin 405 may have grooves (not shown) for sitting air dispenser 615 therein.

It is understood that air passes outward into the water through air holes 637. In order to prevent backflow from entering dispenser 615 and passing through nozzle 613 to pump 603, a bending section is used to prevent fluid to flow back to the air pump as nozzle 613 bends over an edge of liner 290. Additionally, a backflow preventer 639 may be used. Preventer 639 may be located in nozzle 613 or in the tubing of dispenser 615.

Figure 23:
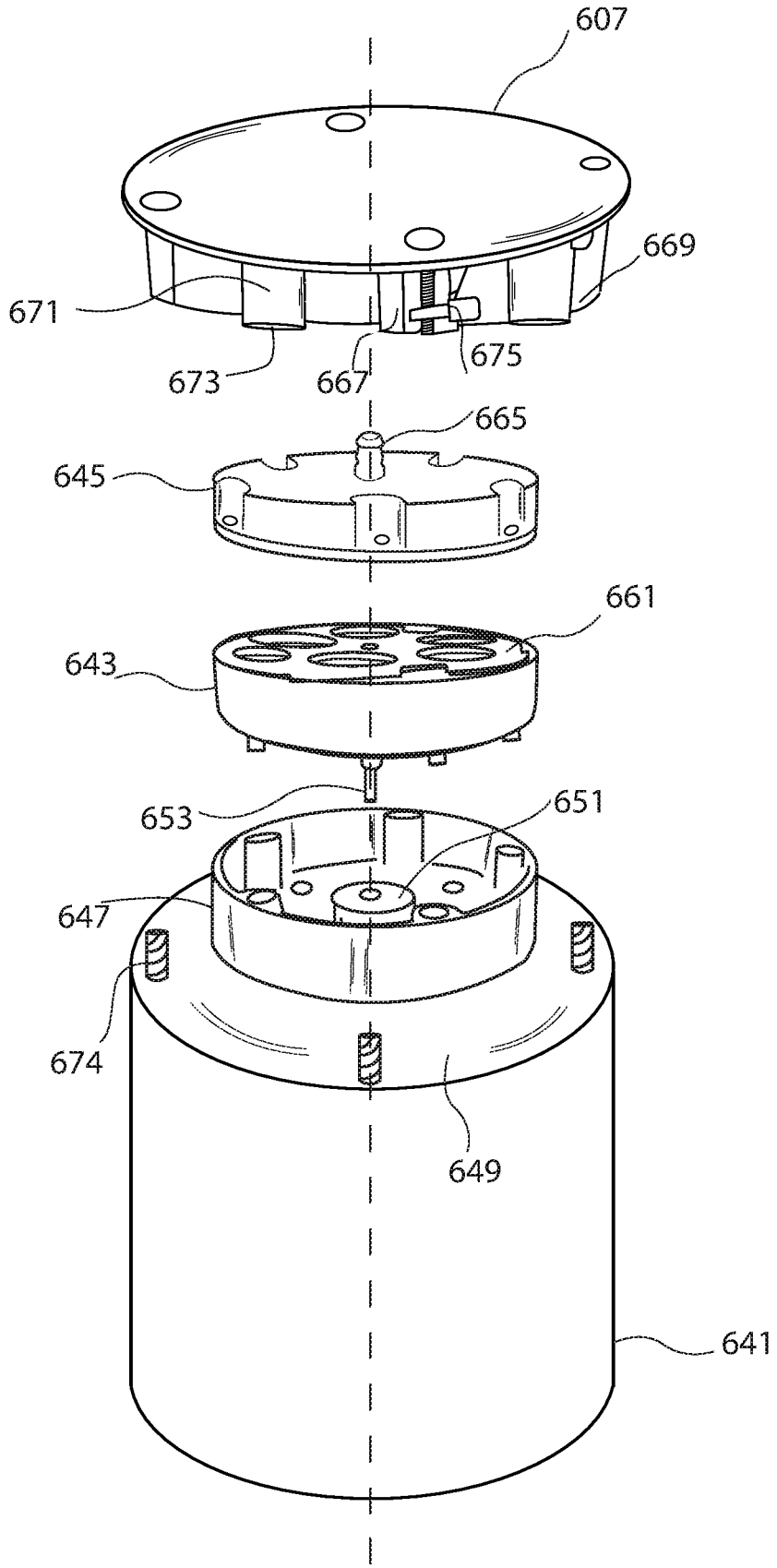
FIG. 23 is an exploded perspective view of the pump of FIG. 21.
Figure 24:
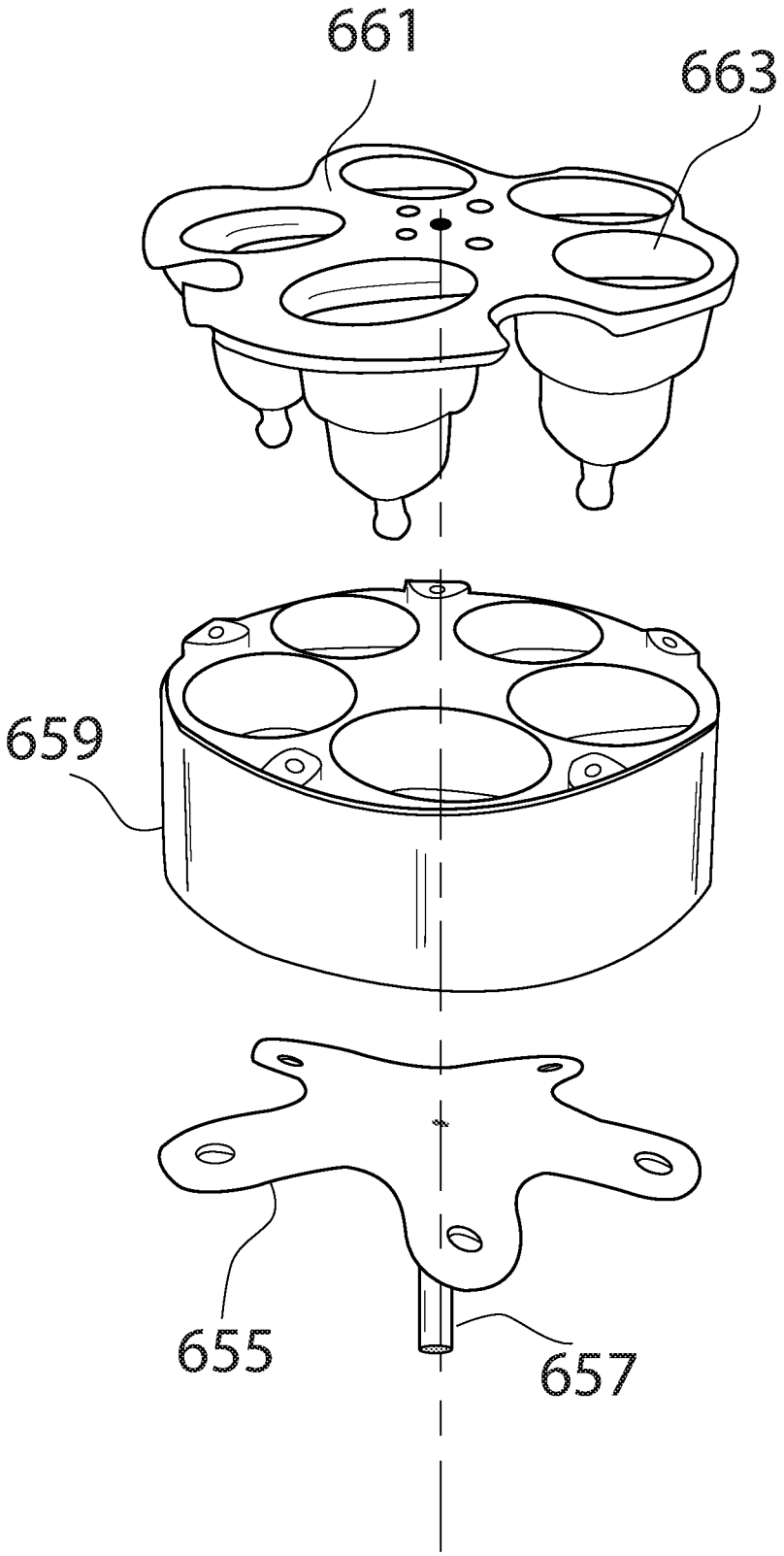
FIG. 24 is an exploded perspective view of an air generator in the pump of FIG. 23.

Referring now also to FIGS. 23 and 24, partially exploded views of pump 603 are illustrated. Pump 603 includes a motor 641 operable with either AC or DC current and is configured to generate a compressed flow of air for dispenser 615. Pump 603 further includes an air generator 643 and an air collector 645. Around the casing of motor 641 is a holder 647 for the air generator 643. Holder 647 extends outward along the axis of motor 641 along face 649. A plurality of hole locations are located around the perimeter, used to hold air collector 645 and air generator 643 partially within holder 647. A motor shaft 651 is externally accessible from motor 641 for communication with shaft 653 of generator 643. Generator 643 seats within holder 647.

Generator 643 includes an air diaphragm holder 655 with a shaft 657. This is located beneath the air generator housing 659 along an inner surface of generator 643. Shafts 657 and 653 are in communication with one another. Resting within housing 659 is an air diaphragm 661 with a plurality of air chamber 663. Chamber 663 pass into hollowed cutouts in housing 659. Air is generated by operating the diaphragm 661 to produce an airflow. The airflow passes through generator 643 and through collector 645 via air pump outlet 665. Nozzle 613 is in fluid communication with the air flow exiting outlet 665.

Each of collector 645 and generator 643 nestle within holder 647 to facilitate mating with mounting housing member 607. Mounting housing member 607 includes a plurality of mounting legs 667. Each of the plurality of mounting legs 667 has a first end 669, a second end 671, and a hollow channel 673 extending from the first end 669 toward the second end 671. Each hollow channel 673 is dimensioned and configured for receiving a corresponding screw 674 of a plurality of screws when the pump 603 is to be secured to the mounting housing member 607. Preferably, the wing nut 675 rotates to extend out to provide a lock for the securement or installation of the mounting housing member 607 to the basin 405. The plurality of screws and wing nut 675 secure or attach the mounting housing member 607 and motor pump 603 to one another when the user screws or tightens the screws into the hollow channel 673 of the mounting legs 667 and rotates the wing nut 675. The tightening of the screws into the hollow channel 673 of the mounting legs 667 and rotation of the wing nut 675 causes pressure to be applied to the gasket or seal 619 and shoulder 617 such that a strong seal will form between the gasket or seal 619 and contact surface of basin 405.

It is understood that a number of components or parts of assembly 601,701 have been discussed. It is known that any of mounting housing member 607, basin 405, liner 290 and other components in the assembly 601,701 may be made or manufactured of plastic, hard plastic, and/or any other suitable material known to one of ordinary skill in the art. Some parts may need flexibility as seen with nozzle 613 and potentially portions of dispenser 615, and in such situations, more rubber or flexible elastomeric materials may be substituted.

As shown in FIG. 1, the spa base 806 may be secured with basin 305,405 as shown in the figure or may be built-in with the basin 305,405. The spa base 806 may be any spa base known to one of ordinary skill in the art, may be dimensioned and configured as any spa base known to one of ordinary skill in the art, and may be made or manufactured of any suitable material known to one of ordinary skill in the art.

As shown in FIG. 1, the chair 808, preferably a massage chair that comprises a backrest, a seat, and armrests, may be secured with the spa base 806 as shown in the figure. The chair 808 may be any chair or massage chair known to one of ordinary skill in the art, may be dimensioned and configured as any chair or massage chair known to one of ordinary skill in the art, and may be made or manufactured of any suitable material known to one of ordinary skill in the art.

It is preferred that the similarly described and/or shown components (such as, but not limited to, mounting housing members 250 and 607; gaskets or seals 265 and 619) are similar, substantially similar or exactly the same as one another.

It is to be understood that the present invention is not limited to the embodiments and non-limiting examples described above or as shown in the attached figures, but encompasses any and all embodiments within the spirit of the invention.

What is claimed is:

1. A spa basin in spa industries comprising:

a basin comprising a sidewall and a fluid-receiving area defined by said sidewall;

an air pump for creating air flow, wherein said air pump comprises an air pump outlet and is designed and configured to be mounted on said sidewall of said basin;

a mounting housing comprising a top surface, a bottom surface, an air nozzle, and a shoulder dimensioned and configured to mount to said sidewall of said basin, wherein said top surface of the mounting housing is connected to said air pump outlet of said air pump, and wherein said air nozzle extends from said top surface of said mounting housing to dispense air generated by said air pump into said basin; and a water sprayer head comprising an inlet, an outlet, and a thermal meter.

2. The spa basin according to claim 1, wherein said thermal meter is an analog thermal meter.

3. The spa basin according to claim 1, wherein said thermal meter is a digital thermal meter.

4. The spa basin according to claim 3, wherein said digital thermal meter comprises an electric generator.

5. The spa basin according to claim 1, wherein said water sprayer head further comprises a backflow preventer.

6. The spa basin according to claim 1, wherein said water sprayer head further comprises a water flow control element.

7. The spa basin according to claim 1, wherein said outlet and said thermal meter of said water sprayer head are positioned in proximity of a top of said sidewall of said basin.

8. The spa basin according to claim 1, wherein said thermal meter is secured to said water sprayer head by threads.

9. A spa basin in spa industries comprising:

a basin comprising a sidewall and a fluid-receiving area defined by said sidewall;

a let assembly comprising a bearing assembly, a shaft assembly, a jet assembly housing, and an impeller, wherein said bearing assembly comprises at least one bearing member, wherein said shaft assembly comprises a shaft member, wherein said shaft member extends through an inner surface of said jet assembly housing, wherein said jet assembly housing comprises said inner surface, an outer surface, a base, a top cover, an impeller-receiving chamber, at least one inlet aperture, and at least one outlet aperture, wherein said base of said jet assembly housing is a unitary structure, wherein said base of said jet assembly housing is enclosed during operation and comprises a first locking portion of a locking unit, and wherein said impeller-receiving chamber is defined by said base and said top cover when said base and said too cover are secured to one another;

a mounting housing comprising a top surface, a bottom surface, and a shoulder dimensioned and configured to mount to said sidewall of said basin, wherein said to surface of said mounting housing comprises a second locking portion of said locking unit, and wherein said jet assembly housing is detachably secured to said top surface of said mounting housing by magnetic coupling;

said locking unit comprising said first locking portion and said second locking portion for securing said jet assembly housing to said mounting housing to prevent rotation of said jet assembly housing during operation; and a water sprayer head comprising an inlet, an outlet, and a thermal meter.

10. The spa basin according to claim 9, wherein said water sprayer head further comprises a water flow control element.

11. The spa basin according to claim 10, wherein said thermal meter is positioned between said inlet and said water flow control element.

12. The spa basin according to claim 9, wherein said water sprayer head is positioned at a position with respect to said basin such that said water sprayer head is capable of spraying water into a hand of a user who is positioned outside of said basin whereby temperature of water is able to be checked by the user and also whereby sanitary condition is maintained.

13. The spa basin according to claim 9, wherein said outlet and said thermal meter of said water sprayer head are positioned in proximity of a top of said sidewall of said basin.

14. The spa basin according to claim 9, wherein said thermal meter is an analog thermal meter.

15. The spa basin according to claim 9, wherein said thermal meter is a digital thermal meter.

16. A spa chair in spa industries comprising:

a basin comprising a sidewall and a fluid-receiving area defined by said sidewall;

an air pump for creating air flow, wherein said air pump comprises an air pump outlet and is designed and configured to be mounted on said sidewall of said basin;

a mounting housing comprising a top surface, a bottom surface, an air nozzle, and a shoulder dimensioned and configured to mount to said sidewall of said basin, wherein said too surface of said mounting housing is connected to said air pump outlet of said air pump, and wherein said air nozzle extends from said top surface of said mounting housing to dispense air generated by said air pump into said basin;

a massage chair comprising a backrest and a seat; and a water sprayer head comprising an inlet, an outlet, a thermal meter.

17. The spa chair according to claim 16, wherein said water sprayer head is positioned at a position with respect to said basin such that said water sprayer head is capable of spraying water into a hand of a user who is positioned outside of said basin whereby temperature of water is able to be checked by the user and also whereby sanitary condition is maintained.

18. The spa chair according to claim 16, wherein said water sprayer head further comprises a water flow control element.

19. The spa chair according to claim 18, wherein said thermal meter is positioned between said inlet and said water flow control element.

20. The spa chair according to claim 18, wherein said water flow control element is positioned between said thermal meter and said outlet.

21. The spa chair according to claim 18, wherein said water flow control element is an on/off switch.

22. The spa chair according to claim 16, wherein said water sprayer head further comprises a backflow preventer.

23. The spa chair according to claim 22, wherein said backflow preventer is positioned adjacent to said inlet.

24. The spa chair according to claim 22, wherein said backflow preventer has a cylindrical shape.

25. The spa chair according to claim 16, wherein said thermal meter is a digital thermal meter.

26. The spa chair according to claim 25, wherein said digital thermal meter comprises an electric generator.

27. The spa chair according to claim 26, wherein said electric generator comprises a coiled copper wire.

28. The spa chair according to claim 26, wherein said electric generator comprises an impeller.

29. The spa chair according to claim 26, wherein said electric generator comprises a magnet.

30. The spa chair according to claim 16, wherein said thermal meter is an analog thermal meter.

31. The spa chair according to claim 16, wherein said inlet of said water sprayer head comprises threads.

32. The spa chair according to claim 16, wherein said outlet and said thermal meter of said water sprayer head are positioned in proximity of a top of said sidewall of said basin.

* * * * *